US011682251B1

(12) United States Patent
Goetz et al.

(10) Patent No.: US 11,682,251 B1
(45) **Date of Patent: *Jun. 20, 2023**

(54) SYSTEMS AND METHODS FOR REMOTELY ACCESSING SECURED SPACES

(71) Applicant: Wells Fargo Bank, N.A., San Francisco, CA (US)

(72) Inventors: Darren M. Goetz, Salinas, CA (US); Viva Gupta, Pleasanton, CA (US); Margaret S. Honeycutt, Crockett, CA (US); Dennis E. Montenegro, Concord, CA (US); Matthew Pearce, Pacifica, CA (US); Erick V. Tengelitsch, Traverse City, MI (US)

(73) Assignee: Wells Fargo Bank, N.A., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/532,263

(22) Filed: Nov. 22, 2021

Related U.S. Application Data

(63) Continuation of application No. 16/694,495, filed on Nov. 25, 2019, now Pat. No. 11,182,995.

(51) Int. Cl.
*G07C 9/00* (2020.01)
*G07C 9/27* (2020.01)
*G07C 9/28* (2020.01)

(52) U.S. Cl.
CPC ..... *G07C 9/00912* (2013.01); *G07C 9/27* (2020.01); *G07C 9/28* (2020.01)

(58) Field of Classification Search
CPC ..... G07C 9/00912; G07C 9/27; G07C 9/28
See application file for complete search history.

(56) References Cited

U.S. PATENT DOCUMENTS 8,881,252 B2 11/2014 Van Till et al.
8,912,879 B2 12/2014 Fyke et al.
(Continued)

OTHER PUBLICATIONS

Nahian et al., "NFC Smart Locker System" http://csce.uark.edu/~ahnelson/CSCE5013/reports/SunnyNahian.pdf 4 pages.
(Continued)

*Primary Examiner* — Mohamed Barakat
(74) *Attorney, Agent, or Firm* — Foley & Lardner LLP

(57) ABSTRACT

Systems, methods, and apparatuses for authenticating devices and using an authenticated device to determine an access decision include a computing system including a network interface circuit that facilitates communication via a network and a processing circuit comprising a processor and memory. The processing circuit approves or denies a request to access a secured device. The processing circuit comprises an access management circuit that receives and interprets the access request to identify a user, an authentication database storing authentication data, and a workforce database storing credential data. The access management circuit retrieves the authentication data from the authentication database to determine the user device associated with the access request. The access management circuit retrieves the credential data from the workforce database based on the identification of the user and the authentication data to determine an access decision and approve or deny access to the secured device.

20 Claims, 13 Drawing Sheets

(56) References Cited

U.S. PATENT DOCUMENTS

| | | | | |
|---|---|---|---|---|
| 9,305,414 | B2 | 4/2016 | Kimoto et al. | |
| 9,413,759 | B2 * | 8/2016 | Chastain | H04L 63/062 |
| 10,096,182 | B2 | 10/2018 | Prasad et al. | |
| 10,198,885 | B2 | 2/2019 | O'Toole et al. | |
| 10,198,887 | B2 | 2/2019 | Ogishi et al. | |
| 10,210,474 | B2 | 2/2019 | Robinson et al. | |
| 10,666,643 | B2 * | 5/2020 | Mathew | H04L 63/18 |
| 10,762,183 | B1 * | 9/2020 | Charan | G06F 21/43 |
| 2014/0035721 | A1 | 2/2014 | Heppe et al. | |
| 2014/0230019 | A1 | 8/2014 | Civelli et al. | |
| 2014/0282985 | A1 * | 9/2014 | Joseph | G06F 21/42 726/9 |
| 2016/0148450 | A1 | 5/2016 | Ohshima | |
| 2016/0300048 | A1 * | 10/2016 | Mason | G06F 21/31 |
| 2016/0343182 | A1 | 11/2016 | Dumas et al. | |
| 2018/0060800 | A1 | 3/2018 | Robinson | |
| 2018/0114180 | A1 | 4/2018 | Uno et al. | |
| 2018/0123795 | A1 * | 5/2018 | Norman | G06F 21/629 |
| 2018/0270667 | A1 | 9/2018 | Gideon, III | |
| 2018/0350177 | A1 | 12/2018 | Dautz et al. | |
| 2018/0359250 | A1 * | 12/2018 | Lerner | H04L 63/0876 |
| 2019/0253255 | A1 | 8/2019 | Mani et al. | |

OTHER PUBLICATIONS

Praba et al., "Bank Locker Security System Using NFC", International Journal of Innovative Research in Computer and Communication Engineering, vol. 5, Special Issue 3, Apr. 2017. 9 pages.

* cited by examiner

SYSTEMS AND METHODS FOR REMOTELY ACCESSING SECURED SPACES

CROSS-REFERENCE TO RELATED APPLICATIONS

This application is a continuation of U.S. patent application Ser. No. 16/694495 (now U.S. Pat. No. 11,182,995) entitled "Systems And Methods For Remotely Accessing Secured Spaces," filed Nov. 25, 2019. Each of the above is incorporated herein by reference in its entirety.

TECHNICAL FIELD

Embodiments of the present disclosure relate generally to the field of authenticating devices and using an authenticated device to determine an access decision.

BACKGROUND

As part of performing employee tasks, many employees are required to access various locations, devices, or storage compartments within a place of employment that restrict access when not occupied by an employee. The locations can include, for example, a storage closet that stores computers or a vault that securely stores cash, gold, and other valuable items. However, due to the number of employees at a typical worksite, it can be difficult to manage the privileges of individual employees to access such locations, devices, or storage compartments.

SUMMARY

A first example embodiment relates to a provider computing system associated with a provider. The system includes a network interface circuit structured to facilitate data communication via a network and a processing circuit comprising a processor and memory. The processing circuit is structured to approve or deny an access request comprising a request to access an external device. The processing circuit comprises an access management circuit structured to receive the access request comprising an indication a user device is proximate the external device and interpret the access request to identify a user associated with the access request, an authentication database structured to store authentication data for a user device associated with the user, and a workforce database structured to store credential data associated with one or more users. The access management circuit is further structured to retrieve the authentication data from the authentication database to determine the user device associated with the access request. The access management circuit is structured to retrieve the credential data from the workforce database based on the identification of the user and the retrieved authentication data to determine an access decision and approve or deny access to the external device by the user based on the access decision.

In various arrangements, the provider computing system is coupled with a device authenticator structured to authenticate the user device based on an authentication signal generated by the provider computing system. The provider computing system can further comprise an authentication circuit structured to generate the authentication signal to allow one or more privileges to the user device based on retrieved credential data. The authentication circuit can be configured to receive a request for an authenticator code and retrieve the authenticator code from the authentication database. The authentication circuit can be structured to generate the authentication signal responsive to receiving a scanned authenticator code signal.

In various arrangements, the access management circuit is further structured to transmit a management request signal to a management device based on the retrieved credential data. The access management circuit can be structured to receive a management decision signal from the management device in response to the management request signal, wherein the management decision signal indicates an access grant decision or an access deny decision.

Another example embodiment relates to a computer-implemented method. The method includes receiving, by a provider computing system, an access request signal from an external device indicative of a user device proximate the external device, the access request signal indicating an access request, interpreting, by the provider computing system, the access request signal to determine an identification of a user and the user device associated with the access request signal, retrieving, by the provider computing system, credential data associated with the user, determining, by the provider computing system, an access decision based on the retrieved credential data, retrieving, by the provider computing system, authentication data for the user device associated with the user, determining, by the provider computing system, the user device associated with the user to which the access decision is transmitted based on the retrieved authentication data, transmitting, by the provider computing system, the access decision to the external device, and approving or denying access to the external device by the user based on the access decision.

In some embodiments, the method further involves receiving, by the provider computing system, a request for an authenticator code from a device authenticator and retrieving the authenticator code from an authentication database. Accordingly, the method can involve receiving, by the provider computing system, a scanned authenticator code responsive to transmitting the authenticator code to a device authenticator. As such, the method can involve generating an authentication signal structured to allow one or more privileges to the user device based on retrieved credential data responsive to receiving the scanned authenticator code. In some arrangements, the method involves transmitting the authentication signal to the device authenticator structured to authenticate the user device based on the authentication signal.

In various arrangements, the method further involves transmitting a management request signal to a management device based on the retrieved credential data. The method can involve receiving a management decision signal from the management device in response to the management request signal, wherein the management decision signal indicates an access grant decision or an access deny decision.

Yet another implementation of the present disclosure is an external device. The external device includes a network interface structured to facilitate data communication via a network a processing circuit comprising a processor and memory and structured to receive a proximity signal indicating a user device is located within a predetermined distance, a proximity sensor structured to receive the proximity signal, and an access device structured to perform an action based on the access control command. The processing circuit is structured to transmit an access request based on the proximity signal, wherein the processing circuit comprises an access decision circuit structured to transmit the access request to a provider computing system, receive an access decision generated based on retrieved credentials of a user associated with the user device and indicating an access approval or an access denial, and generate an access control command based on the access decision. The access control command is structured to grant access to the external device based on the access decision indicating the access approval, by the user, to the external device. The access control command is structured to deny access to the external device based on the access decision indicating the access denial, by the user, to the external device.

In various arrangements, the user device is a mobile device authenticated for use by the user to request access to external device. In some embodiments, the external device is a vault door and the access device is a lock provided by the vault door. The lock provided by the vault door is structured to unlock to grant access to a vault associated with the vault door. The lock provided by the vault door is structured to lock to deny access to a vault associated with the vault door.

In some arrangements, the access decision circuit receives an access decision signal determined by a management decision signal.

DETAILED DESCRIPTION

Figure 1:
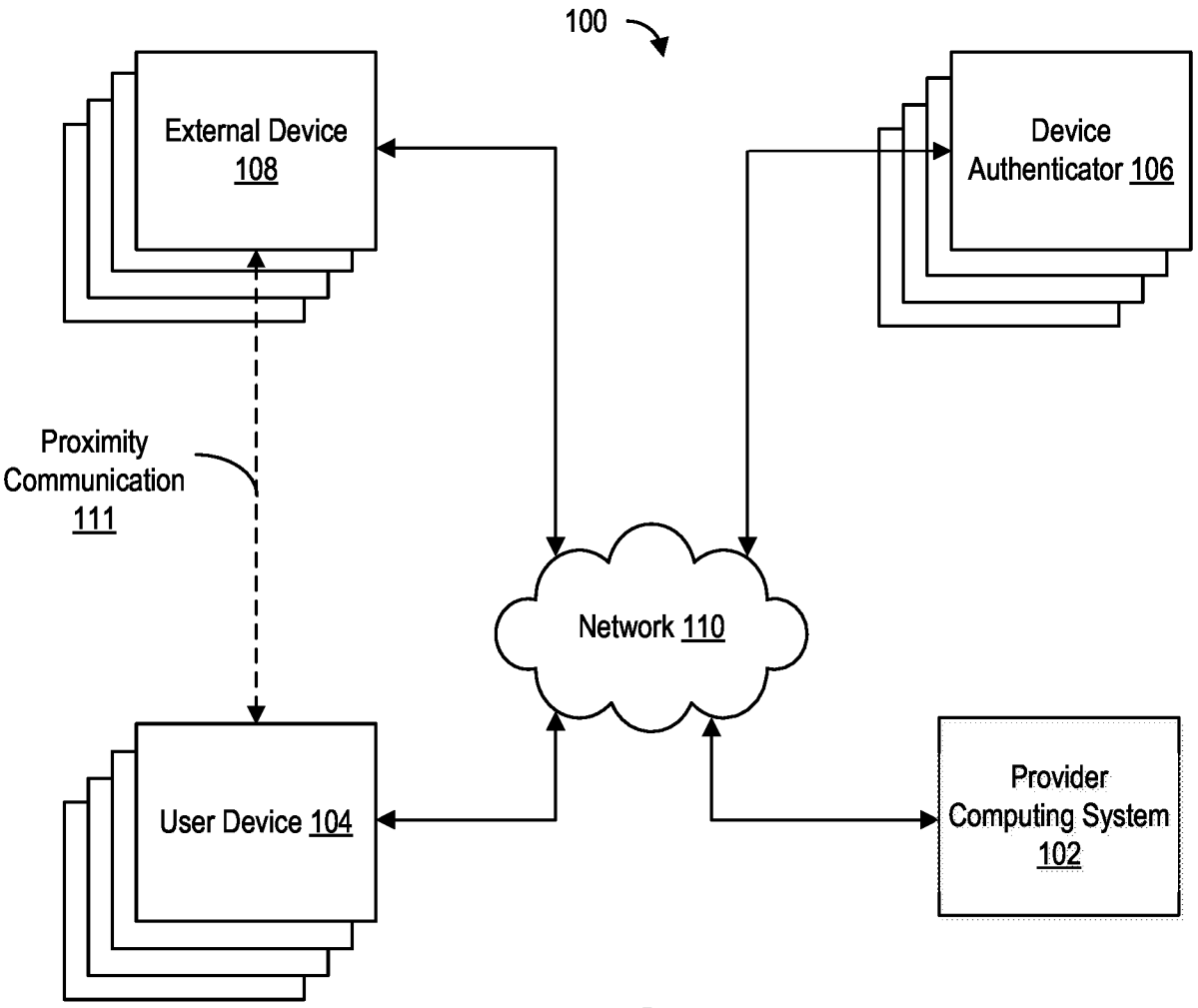
FIG. 1 is a first block diagram depicting a devices authentication and access system, according to an example embodiment.

Referring to the FIGURES generally, various systems, apparatuses, and methods for authenticating devices and using an authenticated device to determine an access decision. An example implementation of the present disclosure is a financial institution (FI) with a plurality of employees having different employment roles, responsibilities, and privileges. Various examples of employment roles include a janitor, a teller, a manager, and a greeter. Various examples of responsibilities include facilitating cash deposits into an account, facilitating cash withdrawals from an account, opening financial accounts, depositing cash into a vault, performing checks and balances of items in a vault. Various examples of privileges include opening a financial account for a patron, performing a credit check of a patron, accessing a cash drawer, and accessing a vault.

To improve employee productivity, patron experience, and ease of performing employee tasks, an employer may provide various devices for the employees to perform their tasks. Various examples of devices may include a mobile phone, a tablet, a personal digital assistant (PDA), and a smart watch. When an employee wishes to use one of these devices, the employee may retrieve the device from a device authenticator that securely stores the devices. As will be described, the device authenticator can be a kiosk that provides compartments to securely store the devices via a lock provided on a compartment door. An employee may input, via a user interface of the device authenticator, employee credentials, such as an employee PIN, to begin a device authentication process. After inputting the employee credentials, the device authenticator unlocks one or more compartment doors so that the user may selectively retrieve a device from a compartment. Alternatively, the device authenticator may unlock a single compartment door permitting access to a single device. Upon retrieval of the device from the compartment, the device authenticator may detect the retrieval by one or more sensors provided within or proximate the compartment.

The device authenticator displays an authenticator code (e.g., a quick response (QR) code) for scanning by the device. The authenticator code is structured to confirm the selection of the device and to receive various device information such as device identification, device type, etc. Upon scanning the device, the user may be prompted to input additional credentials. Accordingly, based on the employee credentials, the device is authenticated for use by the employee. In some arrangements, not all of the features may be authenticated for use by the employee based on the employee's credentials. For example, based on the employee credentials, the employee may be able to access the employee email but not a word processing software.

The employee may use the device to access various external devices within the location of the employer. Various examples of external devices can include a vault door, a storage closet door, a cash drawer, a printer, and a cash-counting machine. Access to these devices may be facilitated by proximity of the device relative the external device. For example, an employee is approaching a vault door to perform a task of depositing cash into the vault. When the employee enters a predetermined region relative the vault door, proximity-based communication is established between the device and the vault door. Accordingly, the vault door may grant or deny access to the vault based on information transmitted by the device. Such information may identify the user, responsibilities, privileges, employee role, device identification, and authenticated features. As will be described the information is used to determine an access decision that allows or denies access to the vault.

Referring now to FIG. 1, a block diagram of a device authentication and access system 100 is shown, according to an example embodiment. As will be described in further detail below, the system 100 facilitates the authentication of one or more user devices 104 and access management of one or more external devices 108 by a user associated with user device 104. As shown, the system 100 includes, among other systems, a provider computing system 102, one or more user devices 104, one or more device authenticators 106, and one or more external devices 108. The provider computing system 102 is shown to be communicatively and operatively coupled to user device 104, device authenticator 106, and external device 108 over a network 110. In addition, or alternatively, to the network 110, user device 104 and external device 108 are shown to be communicatively and operably coupled via a proximity communication 111.

The provider computing system 102 is operated by a provider, which is an entity that facilitates various types of operations between the user device 104, device authenticator 106, external device 108, and various other entities not explicitly described or shown herein. The provider may a bank, credit union, a payment services company, or other similar entities. In various arrangements, provider computing system 102 is configured to authenticate various devices (e.g., user device 104) and grant access requests to external device 108. The features of provider computing system 102 will be described in greater detail with reference to FIG. 2.

The user device 104 is a computing device associated with a user. Although FIG. 1 shows any number of user devices 104 may be included in system 100, for ease of clarity, reference may be made to a single user device 104. As such, it should be understood that system 100 may include any number and/or combination of types of user device 104. The user device 104 includes any type of computing device that may be used to facilitate financial transactions, access various locations within a building, and receive information from provider computing system 102, device authenticator 106, and/or external device 108. In some arrangements, the user uses the user device 104 to access devices (e.g., external device 108) that are otherwise locked, disabled, or inaccessible to other users that do not possess user device 104 or are not authenticated to access such devices. For example, the user device 104 may provide user authentication to external device 108 based on a particular user being authenticated (e.g., logged in, verified) to use user device 104 to access external device 108. As such, a user may access external device 108 via user device 104.

The user device 104 may include any wearable or non-wearable device. Wearable devices refer to any type of device that an individual wears including, but not limit to, a watch (e.g., a smartwatch), glasses (e.g., eyeglasses, sunglasses, smart glasses), bracelet (e.g., a smart bracelet), a badge (e.g., an employee identification card), etc. The user device 104 may also include any type of mobile device including, but not limited to, a phone (e.g., a smartphone), a tablet, a personal digital assistant, and/or computing devices (e.g., desktop computer, laptop computer, personal digital assistant). In some arrangements, the user associated with the user device 104 is an employee of the provider (associated with provider computing system 102). The features of user device 104 will be described in greater detail with reference to FIG. 3.

System 100 is also shown to include device authenticator 106, which can be a station, kiosk, hub, storage unit, etc. structured to store and authenticate devices (e.g., user device 104), according to an example embodiment. In various arrangements, device authenticator 106 provides one or more compartments which can be used to store and secure one or more devices (e.g., user device 104) when not in use. In this regard, device authenticator 106 includes any type of computing device that may be used to perform device authentication operations. Authentication operations can include, but are not limited to, device identification, user authorization, feature (provided by the device) enablement, device unlock, user account uploading, etc. For example, authentication operations may include requesting a user to log in (e.g., by providing a username, an employee ID number), verifying the credentials (e.g., privileges, responsibilities) associated with the user, and enabling the user device 104 to provide one or more features to the user based on the verified credentials of the user. Accordingly, the features that are enabled may differ based on the credentials of the particular user logging into user device 104. For example, a first employee having managerial status may have vault access enabled (e.g., allowing the first employee to access the vault) while a second employee not having managerial status may not have vault access enabled.

Although FIG. 1 shows any number of device authenticators 106 may be included in system 100, for ease of clarity, reference may be made to a single device authenticator 106. As such, it should be understood that system 100 may include any number and/or combination of types of device authenticators 106. For instance, a FI branch location may provide a device authenticator 106 structured as a kiosk configured to perform authentication operations in a break room and a device authenticator 106 structured to store devices and perform authentication operations at a front desk. Accordingly, device authenticator 106 is operated by an administrative entity (e.g., the provider associated with provider computing system 102) to determine appropriate authentication decisions based on credentials of a user associated with user device 104. Upon selection and removal of a device from a compartment, one or more sensors located on, within, or proximal the particular compartment sense the removal of the particular device form the particular compartment. For example, a pressure sensor located in and/or on a bottom side of a particular compartment senses a change in pressure when a device is picked up and removed from the particular compartment. The features of external device 108 will be described in greater detail with reference to FIG. 4.

System 100 is also shown to include external device 108, which can be any type of device configured to selectively allow user access (based on credentials of the user) to various features, locations, etc., according to an example embodiment. External device 108 may include any one or more of a door lock, a vault lock, a cabinet lock, a cash drawer lock, a computer, etc. Although FIG. 1 shows any number of external devices 108 may be included in system 100, for ease of clarity, reference may be made to a single external device 108. As such, it should be understood that system 100 may include any number and/or combination of types of external devices 108. For example, a FI branch location may include a vault door lock, four computers to conduct financial services, four cash drawer locks, each of which selectively allows user access to the respective features. In various arrangements, external device 108 communicates (via network 110 and/or user device 104) with user device 104 to determine a presence of the user device 104 and to facilitate access operations with provider computing system 102. As such, external device 108 communicates with provider computing system 102 to request and receive an access decision that allows or denies access to a particular device associated with external device 108.

The network 110 provides communicable and operative coupling between the provider computing system 102, user device 104, device authenticator 106, external device 108, and other components disclosed and described herein to provide and facilitate the exchange of communications (e.g., data, instructions, messages, values, commands, etc.). Accordingly, the network 110 may include any network include wired (e.g., Ethernet) and/or wireless networks (e.g., 802.11X, ZigBee, Bluetooth, WiFi, etc.). In some arrangements, the network 110 includes the Internet. In further embodiments, the network 110 includes a proprietary banking network to provide secure or substantially secure communications.

The proximity communication 111 provides communicable and operative coupling between the user device 104 and external device 108 to provide and facilitate the exchange of communications (e.g., data, instructions, messages, values, commands, etc.). In some arrangements, proximity communication 111 is a near-field communication that allows coupling of the user device 104 and the device authenticator 106. The use of a proximity communication 111 may allow for the user device 104 to access external device 108 without being connected to the network 110. For example, consider user device 104 being a wireless device (e.g., a mobile phone, a wearable device, a laptop, a tablet) with external device 108 being located in an environment in which wireless access to the network 110 is not obtainable (e.g., located in a concrete cellar). The user device 104 may communicate with external device 108 via proximity communication 111 to request access to external device 108 such that user device 104 need not to communicate with external device 108 via network 110.

Figure 2:
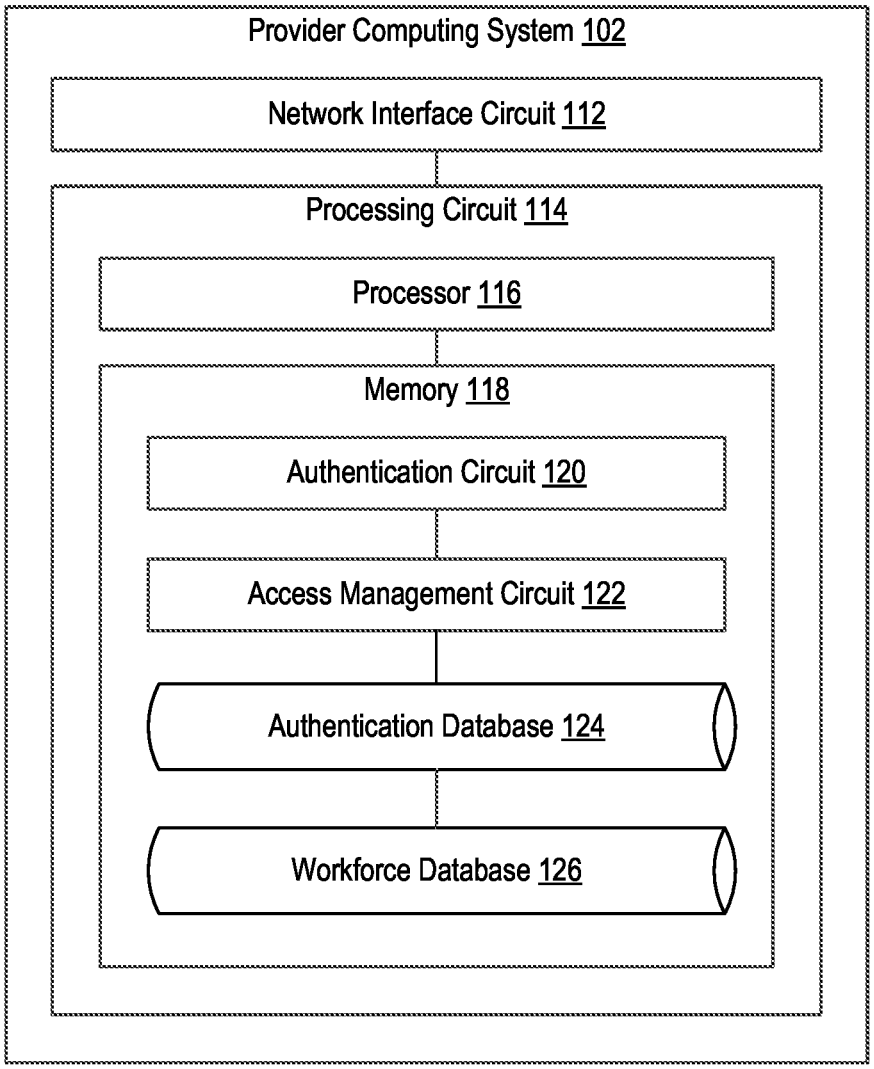
FIG. 2 is a block diagram depicting a provider computing system included in the system of FIG. 1, according to an example embodiment.

Referring now to FIG. 2, the provider computing system 102 is illustrated in greater detail, according to an example embodiment. The provider computing system 102 includes, among other systems, a network interface circuit 112 enabling the provider computing system 102 to exchange data over network 110 and a processing circuit 114. The network interface circuit 112 includes program logic that facilitates connection of the provider computing system 102 to the network 110. The network interface circuit 112 supports communication between the provider computing system 102 and other systems, such as the user device 104, device authenticator 106, and external device 108. For example, the network interface circuit 112 includes a cellular modem, a Bluetooth transceiver, a Bluetooth beacon, a radio-frequency identification (RFID) transceiver, and a near-field communication (NFC) transmitter. In some embodiments, the network interface circuit 112 communicates via a secure wired connection with a branch of a provider associated with the provider computing system 102. In some arrangements, the network interface circuit 112 includes the hardware and machine-readable media sufficient to support communication over multiple channels of data communication. Further, in some arrangements, the network interface circuit 112 includes cryptography capabilities to establish a secure or relatively secure communication session with the provider computing system 102, user device 104, device authenticator 106, and external device 108. In the regard, financial data (or other types of data) may be encrypted and transmitted to prevent or substantially prevent the threat of hacking.

The processing circuit 114 includes a processor 116 and memory 118. The processor 116 may be implemented as one or more application specific integrated circuits (ASICs), field programmable gate arrays (FPGAs), a group of processing components, or other suitable electronic processing components. Memory 118 may be one or more devices (e.g., RAM, ROM, Flash memory, hard disk storage) for storing data and/or computer code for completing and/or facilitating the various processes described herein. Memory 118 may be or include non-transient volatile memory, non-volatile memory, and non-transitory computer storage media. Memory 118 may include database components, object code components, script components, or any other type of information structure for supporting the various activities and information structures described herein. Memory 118 may be communicably coupled to the processor 116 and include computer code or instructions for executing one or more processes described herein. In various arrangements, processing circuit 114 receives signals comprising an authentication information and/or access information. As will be described below, various components included in memory 118 use the received signals to determine various actions (e.g., authenticate a device, grant access to a device, deny access to a device).

The provider computing system 102 is shown to include an authentication circuit 120 structured to generate an authentication signal for a device (e.g., user device 104) that is to be authenticated for use by a user. In general, the term "authentication" refers to the process of granting privileges to one or more features on a device (e.g., user device 104). As will be described in greater detail with reference to FIG. 7, authentication circuit 120 is structured to receive (e.g., from device authenticator 106) a request for an authenticator code indicating a request to authenticate a user device. In turn, authentication circuit 120 generates and transmits (e.g., to device authenticator 106) the authenticator code. The authentication circuit 120 can generate the authenticator code by retrieving an authenticator code that is stored in an authentication database 124. For example, a user wishes to authenticate a device. The authentication circuit 120 receives a request for an authenticator code to from device authenticator 106 for the particular device. Authentication circuit 120 retrieves an authenticator code (which may include a QR code, a bar code, or any scannable code) from authentication database 124 and transmits the authenticator code to device authenticator 106.

In various arrangements, authentication circuit 120 is structured to receive a scanned authenticator code signal from device authenticator 106 and, in response to receiving the scanned authenticator code signal, determine an authentication signal based on retrieved credentials associated with a user who is attempting to authenticate the device. Such an authentication signal can include, for example, identification of the device to be authenticated, one or more features to enable for use by the user, and time period for authentication. In various arrangements, the credentials are retrieved from a workforce database 126 that stores such credentials. In various arrangements, the authentication decision is determined based on employee credentials such as employee role, responsibilities, identification, work assignments, etc. In this regard, the authentication circuit 120 is communicably and operatively coupled to the workforce database 126. Accordingly, the authentication circuit 120 transmits the authentication signal to device authenticator 106 for use in authenticating the device For example, authentication circuit 120 receives a scanned authenticator code signal from device authenticator 106 indicating the authenticator code has been scanned by the device. Authentication circuit 120 analyzes the scanned authenticator code signal to determine if an identification of the device associated with the scanned authenticator code matches a device identification for which the authenticator code was generated. By comparing the identification devices, authentication circuit 120 can determine if the device which scanned the authenticator code matches the device for which the authenticator code was generated, thus preventing an undesirable device from being authenticated by authentication circuit 120. As such, based on retrieved credentials of the user, authentication circuit 120 determines one or more permitted features to authenticate for use by the user via the device. Accordingly, authentication circuit 120 transmits an authentication signal to device authenticator 106 that informs the device authenticator 106 to authenticate the permitted features provided by the device based on the employment role and responsibilities of the user and for an authentication period defined by the scheduled shift length (e.g., 6 hours, 8 hours, 12 hours).

The provider computing system 102 is also shown to include an access management circuit 122 structured to interpret an access request signal received from external device 108 (indicating a user is requesting access to external device 108) and determine an access decision based on retrieved credential data associated with a user who is requesting access to external device 108. As will be described in greater detail with reference to FIGS. 8 and 9, access management circuit 122 is structured to receive and interpret an access request signal to determine a user that is requesting access to an external device (e.g., a vault) via an associated user device (e.g., an authenticated device). In various arrangements, access management circuit 122 is structured to determine an access decision based on the retrieved credential data for the user and transmit the access decision to external device 108 for use in performing an access action. Accordingly, access management circuit 122 is communicably and operatively coupled to external device 108, authentication database 124, and workforce database 126.

For example, access management circuit 122 receives an access request from external device 108 indicating a user is requesting access to external device 108. Access management circuit 122 analyzes the access request signal to identify a user associated with the request (e.g., based on authentication data for the user device 104 with which the use is attempting to access external device 108) and retrieves credential data (e.g., name, employee role, responsibilities, privileges) for the identified user from workforce database 126. Access management circuit 122 analyzes said retrieved credentials for the user to determine an access decision and retrieves authentication data for the user device 104 to determine if the user device 104 is authenticated to perform such a feature as proximity-based access. Such an access decision may include an "allow access" decision which is structured to permit access to external device 108 by the user or a "deny access" decision which is structured to restrict access to external device 108 the by the user. As such, access management circuit 122 transmits the access decision to the external device 108 for use by external device 108 in performing an access action (e.g., unlock, allow access, open, close, restrict access, remain locked).

In various arrangements, access management circuit 122 is structured to communicate with a user having a higher position (e.g., a manager, a supervisor, an owner) than the user requesting access in order to determine an access decision (herein referred to as a managerial decision). In such embodiments, access management circuit 122 determines the requirement to seek a managerial decision based on the retrieved credential data for the user requesting access. For example, a teller is approaching a vault to deposit cash, but the privileges associated with the teller allow the teller access to the vault based on a managerial decision. Access management circuit 122 determines the need for a managerial decision and transmits a management request signal indicating the teller is requesting permission to access the fault. As such, upon receiving a management decision signal, access management circuit 122 will interpret the management access decision to determine an access decision.

The provider computing system is also shown to include an authentication database 124 structured to store authentication data associated with one or more user devices. Such authentication data may include identification of devices that are authenticated at a particular time, identification of devices that are not authenticated at a particular time, identification of the one or more privileges assigned to the authenticated devices, identification of users logged into an authenticated device, actions performed using an authenticated device, etc. Accordingly, authentication database 124 is communicably and operatively coupled to authentication circuit 120 and access management circuit 122.

The provider computing system 102 is also shown to include a workforce database 126 structured to store credential data associated with one or more users. More specifically, workforce database 126 is structured to store credential data associated with employees of the provider associated with provider computing system 102. In some embodiments, workforce database 126 stores credential data associated with patrons of the provider. Such credential data may include, but is not limited to, name, employee or account number, job title, permitted privileges, etc. Accordingly, authentication database 124 is communicably and operatively coupled to authentication circuit 120 and access management circuit 122

Figure 3:
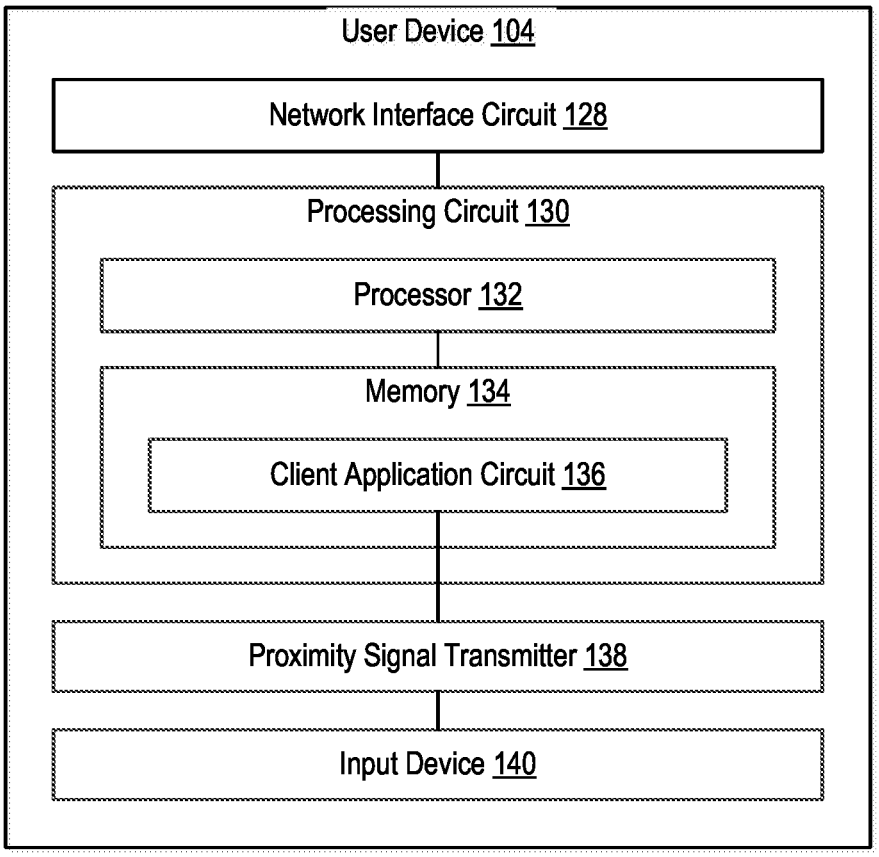
FIG. 3 is a block diagram depicting a user device included in the system of FIG. 1, according to an example embodiment.

Referring now to FIG. 3, user device 104 is shown in greater detail, according to an example embodiment. In various arrangements, the user device 104 is a computing device provided by the provider associated with provider computing system 102. In such arrangements, user device 104 is a device that an employee checks out upon arriving to work (e.g., at a branch location, at a corporate location). User device 104 includes a network interface circuit 128 enabling the user device 104 to exchange information over the network 110, a processing circuit 130, a proximity signal transmitter 138 enabling the user device 104 to exchange information via proximity communication 111, and an input device 140. Processing circuit 130 is shown to include a processor 132 and memory 134 including a client application circuit 136. Processing circuit 130, processor 132, and memory 134 may be the same or similar as the processing circuit 114, processor 116, and memory 118 respectively described with reference to the provider computing system.

The network interface circuit 128 of the user device 104 is adapted for and configured to establish a communication session via the network 110 between the user device 104 and other systems, such as the provider computing system 102, the device authenticator 106, and external device 108. Accordingly, the network interface circuit 128 includes any of a cellular transceiver (Code Division Multiple Access (CDMA), Global System for Mobile Communications (GSM), Long-Term Evolution (LTE), etc.), a wireless network transceiver (e.g., 802.11X, ZigBee, Bluetooth, etc.), or a combination thereof (e.g., both a cellular transceiver and a Bluetooth transceiver). In some embodiments, the network interface circuit 128 communicates via a secured wired connection within a branch of the provider associated with the provider computing system 102. The network interface circuit 128 may be the same or similar as the network interface circuit 1128 previously described with reference to the provider computing system 102.

The client application circuit 136 included in the user device 104 is structured to provide displays to the user device 104 that enable the user perform various operations. Such operations may include participating in authentication operations to authenticate the user device 104, accessing external device 108, and performing workforce tasks. For example, the client application circuit 136 may generate a screen requesting a user input of an employee ID number in order to authenticate the user device 104. In another example, the client application circuit 136 may generate a screen requesting a user PIN number in order to determine an access decision that allows or denies the associated user access to external device 108. In yet another example, the client application circuit 136 may generate a screen allowing for a customer to input customer information (e.g., account number, withdrawal information, deposit information) in order to complete a financial operation (e.g., deposit funds, withdraw funds). Accordingly, the client application circuit 136 is communicable and operatively coupled to the provider computing system 102, device authenticator 106, and/or external device 108.

In some embodiments, the client application circuit 136 may be incorporated with an existing application in use by the provider (e.g., a mobile application or a mobile wallet application). In other embodiments, the client application circuit 136 may be downloaded by the user device 104 prior to its usage, hard-coded into the memory 134 of the user device 104, or be a web-based interface application, which may be executed remotely from the user device 104. In the latter instance, the user may have to log onto or access the web-based interface before usage of the application. Further, and in this regard, the client application circuit 136 may be supported by a separate computing system including one or more servers, processors, network interface circuits, etc. that transmit applications for use to the user device 104. In certain embodiments, the client application circuit 136 includes an API and/or a software development kit (SDK) that facilitate the integration of other applications with the client application circuit 136.

In various arrangements, client application circuit 136 is structured transmit a scanned authenticator code signal and receive an authentication signal. In such arrangements, client application circuit 136 communicates with an input device 140 (structured to scan an authenticator code) to generate the authenticator code signal. Accordingly, client application circuit 136 transmits the authenticator code signal to device authenticator 106. For example, client application circuit 136 receives a scanned QR code (e.g., the authenticator code) from input device 140. As such, client application circuit 136 transmits an authenticator code signal comprising the authenticator code to device authenticator 106. In various arrangements, client application circuit 136 receives an authentication signal (e.g., responsive to the transmitted authenticator code signal) instructing the client application circuit 136 to enable one or more features provided by the user device 104. For example, a teller is performing authentication operations for a tablet device. The tablet device enables a cash drawer feature allowing the teller to observe an amount of cash in a particular cash drawer. Such a cash drawer may be an assigned physical location for the teller for a certain shift.

In various arrangements, the client application circuit 136 is structured to generate and display access information associated with a request to access external device 108. As will be described in greater detail with reference to FIGS. 11-14, such information may include a present state of determining an access decision. For example, upon transmission of an access request, client application circuit 136 may generate and display access information indicating that the access request has been issued. In another example, upon allowance of access to external device 108, client application circuit 136 may generate and display access information indicating that the access decision is allowing the user access to external device 108. In various arrangements, client application circuit 136 is structured to generate and display a request for user input to facilitate the transmission of an access request. For example, client application circuit 136 may generate a field in which the user may input an employee ID number prior to the transmission of an access request. In another example, client application circuit 136 may generate a plurality of selection buttons each identifying a device by which a user may select a particular device he or she wishes to access. In this regard, client application circuit 136 communicates with external device 108 in order to generate such displays.

User device 104 is also shown to include a proximity signal transmitter 138. The proximity signal transmitter 138 is structured to transmit a proximity signal and enable communication with external device 108 via proximity communication 111. Proximity signal transmitter 138 may continuously or intermittently, based on a transmission interval (e.g., every 1 second, every 5 seconds), transmit a proximity signal which can be received by external device 108 to establish near-field communication between user device 104 and external device 108 via proximity communication 111. Proximity signal transmitter 138 may be structured as any near- field transmitter device such as a radio-frequency identification (RFID) transceiver or a near- field communication (NFC) transmitter. All such variations are intended to fall within the spirit and scope of the present disclosure.

In various arrangements, the proximity communication enabled by the proximity signal transmitter 138 is used to detect a location of the user device 104 relative external device 108. For example, upon user device 104 entering a predetermined region relative external device 108, the communication enabled by the user device 104 entering such a region may be used to detect that the user device 104 is within the predetermined region. In various arrangements, and as will be described in greater detail below, user information and user device information may be transmitted to external device 108 for use in transmitting an access request. For example, a user device 104 associated with a user approaching external device 108 structured as a vault door establishes communication via proximity communication 111 by proximity signal transmitter 138 with external device 108. Upon establishment of such communication, the user information and user device information is transmitted from user device 104 to external device 108 via proximity communication 111. Such information is used by external device 108 in performing an access action which may grant or deny access by the user associated with user device 104 to external device 108. Such information may include, but is not limited to, employee identification, job titled, responsibilities, device authentication information, device identification. Accordingly, proximity signal transmitted 138 is communicably and operatively coupled to external device 108.

User device 104 is shown to include an input device 140 structured to facilitate a user interaction with the user device 104. The input device 140 can be any piece of hardware such as a touchscreen, a keyboard, a mouse, etc. Accordingly, the user device is communicably and operate coupled to the provider computing system 102, device authenticator 106, and external device 108. In various arrangements, input device 140 is used to facilitate authentication operations performed by device authenticator 106. For example, as part of authentication user device 104, device authenticator 106 may request log-in information from the user into user device 104. As such, the user may input the requested log-in information via input device 140. In some arrangements, input device 140 is used to facilitate access operations performed by external device 108. For example, as part of accessing external device 108, external device 108 may request a user to verify a user password. As such, the user may input the requested user password via input device 140.

Figure 4:
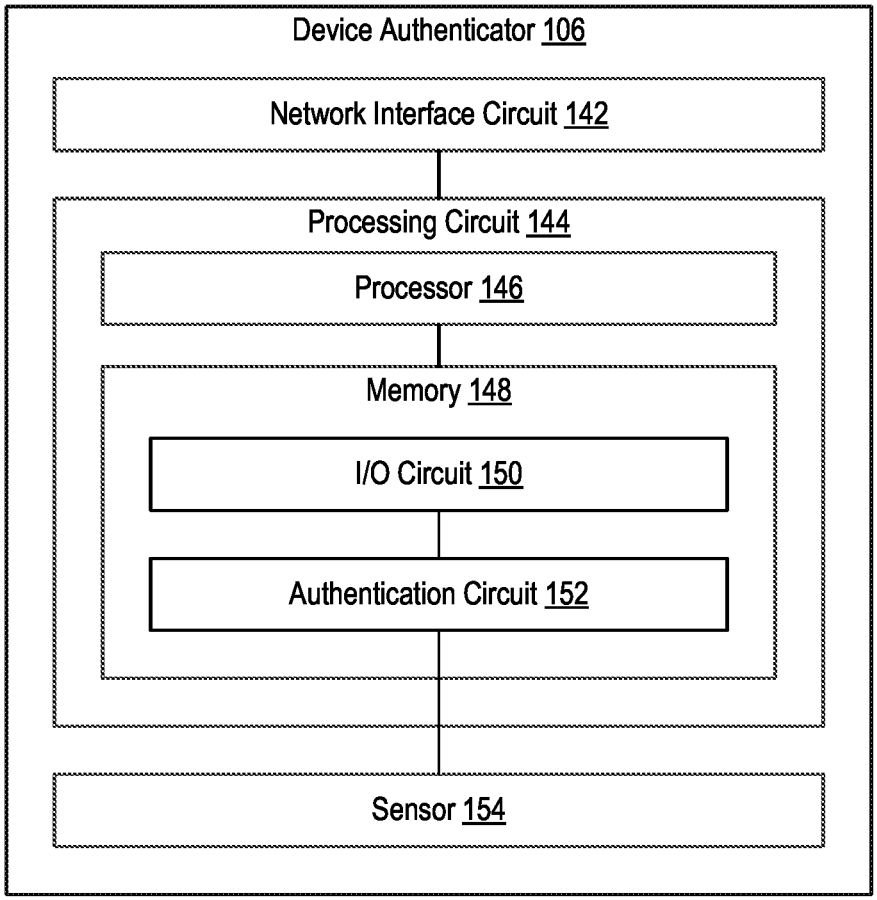
FIG. 4 is a block diagram depicting a device authenticator included in the system of FIG. 1, according to an example embodiment.

Referring now to FIG. 4, device authenticator 106 includes a network interface circuit 142 enabling the device authenticator 106 to exchange information over the network 110, a processing circuit 144, and a sensor 154, according to an example embodiment. Processing circuit 144 is shown to include a processor 146 and memory 148 including an input/output (I/O) circuit 150 and an authentication circuit 152. Processing circuit 144, processor 146, and memory 148 may be the same or similar as the processing circuit 114, processor 116, and memory 118 respectively described with reference to the provider computing system 102.

The network interface circuit 142 of the device authenticator 106 is adapted for and configured to establish a communication session via the network 110 between the device authenticator 106 and other systems, such as the provider computing system 102, the user device 104 and the external device 108. Accordingly, the network interface circuit 142 includes any of a cellular transceiver (Code Division Multiple Access (CDMA), Global System for Mobile Communications (GSM), Long-Term Evolution (LTE), etc.), a wireless network transceiver (e.g., 802.11X, ZigBee, Bluetooth, etc.), or a combination thereof (e.g., both a cellular transceiver and a Bluetooth transceiver). In some embodiments, the network interface circuit 142 communicates via a secured wired connection within a branch of the provider associated with the provider computing system 102. The network interface circuit 142 may be the same or similar as the network interface circuit 112 previously described with reference to the provider computing system 102.

The device authenticator 106 is shown to include an input/output (I/O) circuit 150 structured to receive and provide communications to a user (e.g., an employee) of the device authenticator 106. In this regard, the I/O circuit 150 is structured to exchange data, communications, instructions, etc. with the user device 104 and/or a user associated with the user device 104. Accordingly, in one embodiment, the I/O circuit 150 includes an input/output device such as a display device, a touchscreen, a keyboard, a microphone, a barcode scanner, and/or a QR scanner. In various arrangements, the I/O circuit 150 includes communication circuitry for facilitating the exchange of data, values, messages, and the like between an input/out device and the components of the device authenticator 106. In some embodiments, the I/O circuit 150 includes machine-readable media for facilitating the exchange of information between the input/out device and the components of the device authenticator 106. In still another embodiment, the I/O circuit 150 includes any combination of hardware components (e.g., a touchscreen), communication circuitry, and machine-readable media.

The I/O circuit 150 includes hardware structured to facilitate authentication of a device (e.g., user device 104) that is selected by a user. In this regard, I/O circuit 150 is communicably and operatively coupled to an authentication circuit 152 to receive requested authentication information from a user and to transmit received authentication information that is inputted by a user via I/O circuit 150. In some arrangements, I/O circuit 150 provides a display that generates an authenticator code (e.g., a QR code, a barcode) for scanning by the user device 104 for use in authentication operations. In some arrangements, I/O circuit 150 includes a keypad structured to facilitate manual input of user information (e.g., username, employee name, employee ID number, device number). For example, a user inputs an employee ID number using a keypad provided by the I/O circuit 150 in order to check out a user device 104.

The authentication circuit 152 is structured to facilitate authentication operations for a device, according to an example embodiment. In some embodiments, authentication circuit 152 communicates with I/O circuit 150 to transmit an authenticator code to I/O circuit 150 and receive a scanned authenticator signal from user device 104. Such an authenticator code may be transmitted to authentication circuit 152 by provider computing system 102. In some such embodiments, authentication circuit 152 is structured to request the authenticator code from provider computing system 102 and transmits the scanned authenticator code to provider computing system 102. Accordingly, authentication circuit 152 is communicably and operatively coupled to I/O circuit 150, provider computing system 102, and user device 104. For example, a user wishes to authenticate a device. The authentication circuit 152 transmits a request for an authenticator code to provider computing system 102 for the particular device. Authentication circuit 152 receives an authenticator code (which may include a QR code, a bar code, or any scannable code) from provider computing system 102 and transmits the authenticator code to I/O circuit 150 for display user. Upon the user scanning the authenticator code with the particular device, authentication circuit 152 receives a scanned authenticator code signal from the particular device. As such, authentication circuit 152 transmits the scanned authenticator code to provider computing system 102 for use in authenticating the particular device.

In various arrangements, authentication circuit 152 is structured to receive an authentication signal from provider computing system 102 responsive to transmitting a scanned authenticator code. Such an authentication signal may identify one or more features (provided by the user device 104) to authenticate and enable for use by a particular user. Accordingly, authentication circuit transmits the authentication signal to user device 104, enabling one or more features of user device 104 determined by the authentication signal. As such, device authenticator 106 transmits authenticated device information to provider computing system 102 responsive to authenticating user device 104.

The device authenticator 106 is also shown to include a sensor 154 structured to detect the selection of a device stored by device authenticator 106. Sensor 154 may be any device configured to retrieve data to facilitate the detection of a device that is removed (e.g., selected) from device authenticator 106. In this regard, sensor 154 may be any type of sensor such as a pressure sensor, a proximity sensor, or an IR sensor. For example, a pressure sensor located in and/or on a bottom side of a particular compartment storing a device senses a change in pressure when the device is picked up and removed from the particular compartment. The change in pressure indicates that the device has been selected. As such, sensor 154 communicates with authentication circuit 152 to transmit the retrieved data. Accordingly, sensor 154 is communicably and operatively coupled to authentication circuit 152.

Figure 5:
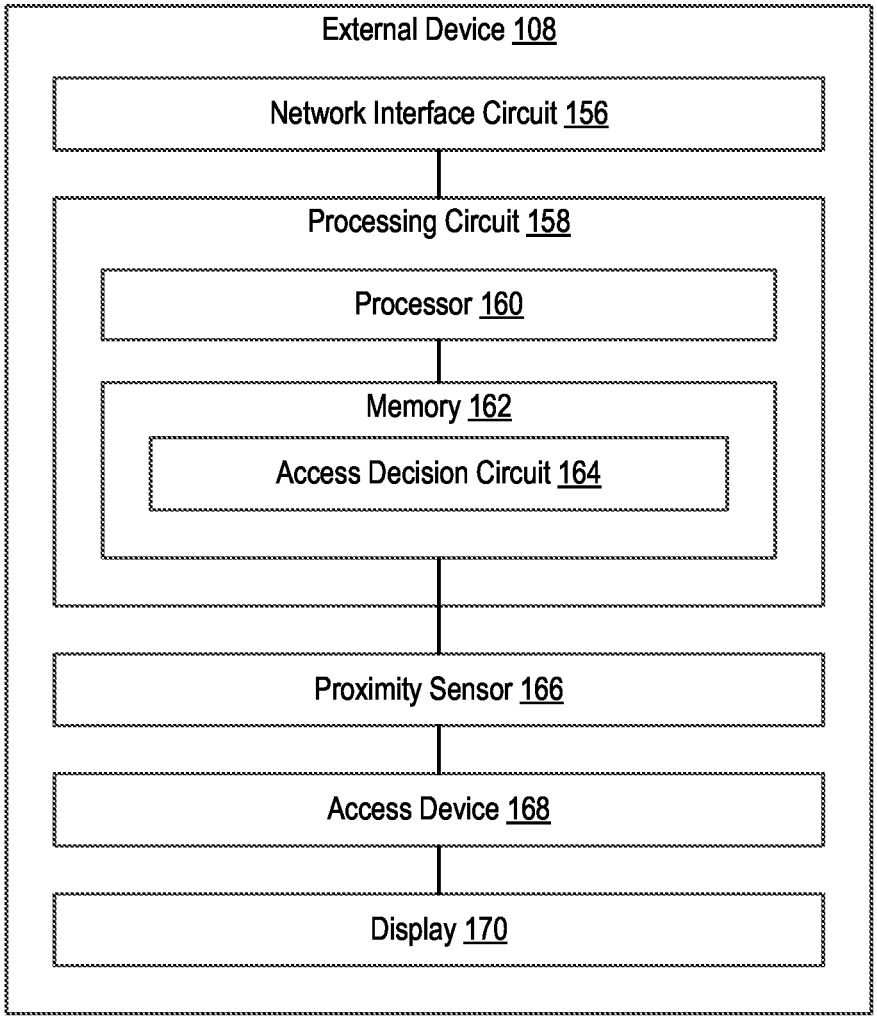
FIG. 5 is a block diagram depicting an external device included in the system of FIG. 1, according to an example embodiment.

Referring now to FIG. 5, external device 108 is shown in greater detail, according to an example embodiment. In various arrangements, external device 108 is structured to selectively allow a user access to use features provided by the external device 108. For example, external device 108 may be structured as a vault door lock that, when granted access by external device 108, unlocks for a user to enter a vault associated with the vault door lock. External device 108 is shown to include a network interface circuit 156 enabling the external device 108 to exchange information over the network 110, a processing circuit 158, a proximity sensor 166, an access device 168, and a display 170, according to an example embodiment. Processing circuit 158 is shown to include a processor 160 and memory 162 including an access decision circuit (ADC) 164. Processing circuit 158, processor 160, and memory 162 may be the same or similar as the processing circuit 114, processor 116, and memory 118 respectively described with reference to the provider computing system 102.

The network interface circuit 156 of the external device 108 is adapted for and configured to establish a communication session via the network 110 between the external device 108 and other systems, such as the provider computing system 102 and the user device 104. Accordingly, the network interface circuit 142 includes any of a cellular transceiver (Code Division Multiple Access (CDMA), Global System for Mobile Communications (GSM), Long-Term Evolution (LTE), etc.), a wireless network transceiver (e.g., 802.11X, ZigBee, Bluetooth, etc.), or a combination thereof (e.g., both a cellular transceiver and a Bluetooth transceiver). In some embodiments, the network interface circuit 156 communicates via a secured wired connection within a branch of the provider associated with the provider computing system 102. The network interface circuit 156 may be the same or similar as the network interface circuit 112 previously described with reference to the provider computing system 102.

In various arrangements, ADC 164 is structured to transmit an access request based on a received proximity signal, receive an access decision responsive to the request, and generate an access control command based on the received access decision. Accordingly, ADC 164 is communicably and operatively coupled to proximity sensor 166, provider computing system 102, and access device 168. In various arrangements, ADC 164 receives a proximity signal from proximity sensor 166 indicating that a user device is requesting access to external device 108. As will be described in greater detail below, the proximity signal may be transmitted based on user device 104 establishing proximity communications with external device 108 via proximity sensor 166. For example, a user approaching external device 108 enters a predetermined region associated with external device. By the user entering the predetermined region, proximity communication is established by the user device 104 and the proximity sensor 166. Responsive to the established proximity communications, ADC 164 receives a proximity signal from proximity sensor 166. In such arrangements, ADC 164 transmits an access request to provider computing system 102 requesting an access decision based on the user device (and user associated therewith) associated with the proximity signal.

In various arrangements, ADC 164 receives an "allow access" access decision indicating that the user is permitted to access external device 108. In such arrangements, constraints may be placed on the "allow access" access decision such as a period of time which the user may access external device 108, access to external device 108 is contingent based on the presence management personnel with the user accessing external device 108, number of occurrences that the user may access external device 108, etc. Alternatively, ADC 164 receives a "deny access" access decision indicating that the user is denied access to external device 108. Accordingly, ADC 164 interprets a received access decision to determine an access control command. Such an access control command may be to unlock a lock, remain locked, log into a computing device using user credentials, etc. As such, ADC 164 transmits the access control command to access device 168 for use in performing an access action based on the access control command.

The proximity sensor 166 is structured to enable communication between user device 104 and external device 108 via proximity communication 111, according to an example embodiment. Proximity sensor may receive a proximity signal transmitted by user device 104 and determine that user device 104 is within a predetermined region relative to external device 108. For example, upon user device 104 entering a predetermined region relative external device 108, the proximity communication enabled by the user device 104 entering such a region may be used to detect that the user device 104 is within the predetermined region. Proximity sensor may be structured as any near-field communication device such as a radio-frequency identification (RFID) transceiver or a near-field communication (NFC) transmitter. All such variations are intended to fall within the spirit and scope of the present disclosure.

In some arrangements, proximity sensor 166 receives user information and user device information as part of a received proximity signal. As such, receiving such information by proximity sensor 166 may trigger ADC 164 to transmit an access request to provider computing system 102 using the received user information and user device information. Accordingly, the proximity sensor 166 is communicably and operatively coupled to user device 104 and ADC 164. In various arrangements, proximity sensor 166 communicates with user device 104 to request user input (e.g., for use in determining an access decision). For example, as part of determining an access decision, a user input comprising an employee ID number may be requested. As such, proximity signal communicates with user device 104 to transmit the request for the user input and receive the user input.

Access device 168 can include any type of device which physically or digitally controls access to external device 108 based on a received access action. In some arrangements, access device 168 is a lock configured to restrict access to external device 108 when in a locked state or allow access to external device 108 when in an unlocked state. In some arrangements, access device 168 is a device configured to deny or allow access by a user to an electronic device. For example, access device 168 may be an RFID transceiver configured to log a user into a computer based on credentials received from user device 104. Based on the received credentials, access device 168 may or may not log the user into the computer. In another example, access device 168 is a vault door lock. In various arrangements, access device 168 communicates with ADC 164 to receive an access control command. In such arrangements, access device 168 performs an action (e.g., lock, unlock, log in, turn on) in accordance with the access control command. Accordingly, access device 168 is communicably and operatively coupled to ADC 164.

External device 108 is shown to include a display 170 used to generate and present various access information to users on the external device 108. In this regard, display 170 is communicably and operatively coupled to ADC 164 to provide a user interface for receiving and displaying information on the external device 108. Examples of user interfaces will be described with reference to FIGS. 15-20 and may include digital screens, lights, voice instructions, etc. In various arrangements, display 170 provides instructions (e.g., determined by ADC 164) to the user for facilitating an access action by the external device 108. For example, display 170 presents an instruction to a user requesting that the user inputs an employee PIN to verify the identification of the user associated with the user device 104. In some arrangements, display 170 is structured to generate and present a status of access device 168. For example, when access device 168 is in a locked state, display 170 may generate and present a screen displaying "LOCKED." Accordingly, display 170 is communicably and operatively coupled to access device 168.

Figure 6:
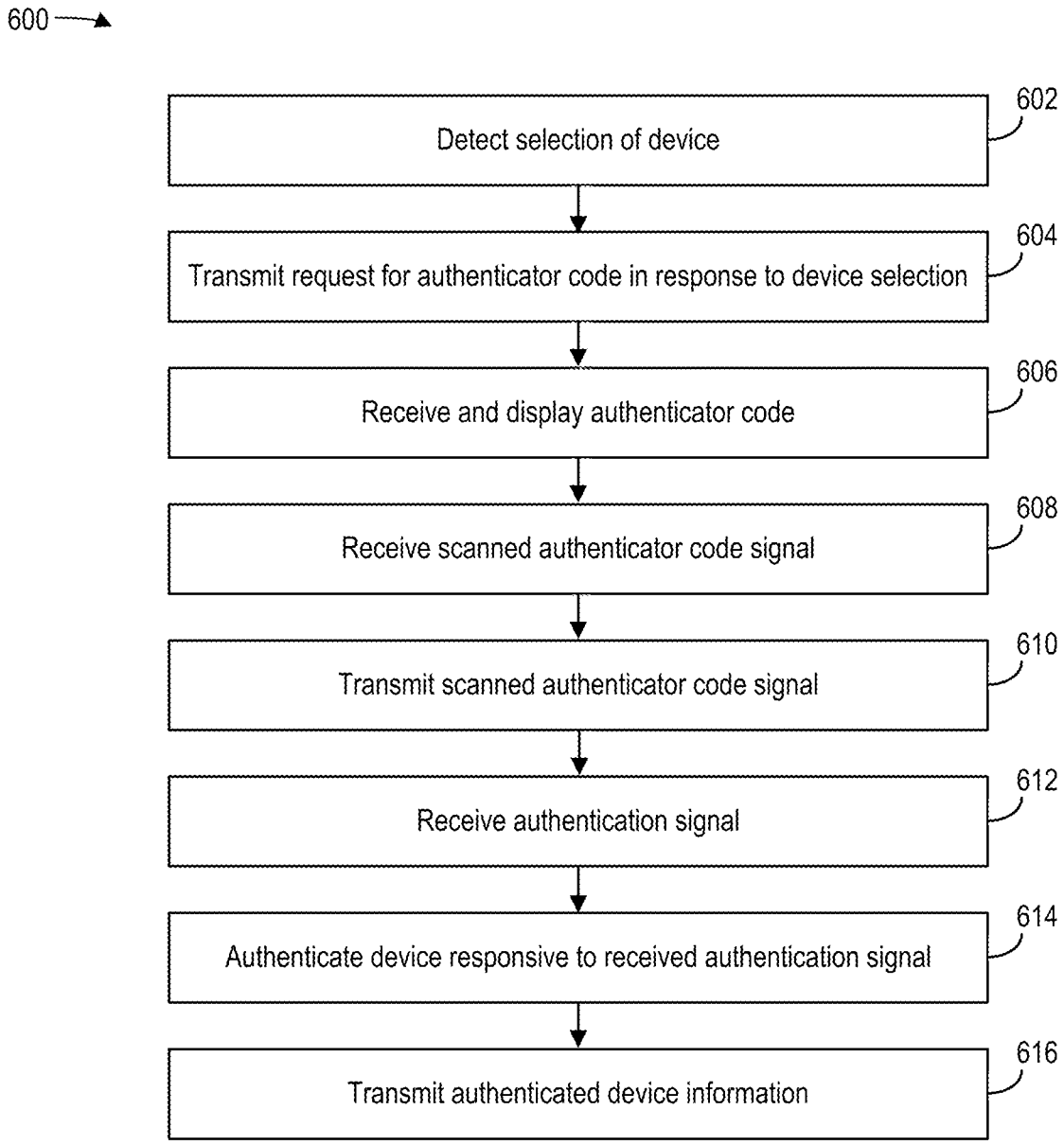
FIG. 6 is a flowchart depicting a method for authenticating a device using a device authenticator, according to an example embodiment.

Referring now to FIG. 6, a flowchart of a method 600 for authenticating a device using a device authenticator is shown, according to an example embodiment. In various embodiments, the method 600 is performed by the components of system 100 shown in FIG. 1 such that reference may be made to components of FIG. 1 to aid the description of method 600. In some arrangements, through the method 600, the device authenticator 106 detects the selection of a device, displays an authenticator code structured to verify the selected device, and authenticate the selected device based on a received authentication signal. In various arrangements, the method 600 is performed by device authenticator 106.

An exemplary implementation of the method 600 is a FI branch location including employees working to perform financial services provided by the corresponding FI to patrons of the branch location. At the start of a shift, an employee approaches device authenticator 106 which may be, as previously described, a kiosk or station that stores one or more user devices 104 and selects a user device 104. Upon removal of the user device 104, device authenticator 106 detects that the user device 104 has been removed from a storage cubby provided by the device authenticator 106 via one or more sensors located within or proximate the particular storage cubby. The user approaches device authenticator 106 and inputs, via I/O circuit 150, various requested credentials (e.g., name, username, employee ID, device ID number). Device authenticator 106 communicates with provider computing system 102 to perform method 600. Upon performing method 600, the user device is authenticated with various privileges pertaining to the credentials (e.g., employee title, duties, responsibilities) of the employee.

A selected device is detected at step 602. In various embodiments, the selected device is a device stored in a storage compartment (e.g., a cubby, a container, a locker, a receptacle) provided by device authenticator 106. Accordingly, upon selection of the device, the removal of the device from the corresponding storage compartment is detected by device authenticator 106. In some embodiments, the selected device is detected by one or more sensors such as pressure sensors, proximity sensors, thermometers, etc. which can be provided by device authenticator 106. For example, upon selection of a device, the device is removed from a storage cubby provided by device authenticator 106. Upon removal of the device from the storage cubby, a pressure sensor located in the cubby detects that the device has been removed by the removal of the pressure of the device. In some embodiments, the selected device is detected by decoupling of the device from one or more wires (e.g., charging wires, USB cord,) provided by device authenticator 106.

A request for an authenticator code is transmitted in response to detecting the selected device at step 604. In various embodiments, the request is transmitted by device authenticator 106 to provider computing system 102. In such arrangements, the request is transmitted as a signal from device authenticator 106 to provider computing system 102. In some arrangements, the request includes information of the selected device. In this regard, information about the selected device such as device number, device name, device type, etc. can be transmitted as part of the request. In various arrangements, the request includes user information (e.g., identification, employee ID, shift) of the user who selected the device. Such information may be retrieved via user device 104 or device authenticator 106 before transmitting the request for an authenticator code. The request for an authenticator code can be transmitted via network 110.

An authenticator code is received responsive to the transmitted request at step 606. Accordingly, the authenticator code is displayed. The authenticator code received can include any type of code, characters, or pictures used to authenticate a device. For example, the authenticator code may be a QR code. In this regard, the authenticator code is received by device authenticator 106 from provider computing system 102. Accordingly, the authenticator code is displayed (e.g., on a display) in response to receiving the authenticator code. In various arrangements, the authenticator code is displayed for a predetermined amount of time (e.g., 30 seconds) before displaying the code ends (e.g., by turning off a display, by removing the authenticator code from a display). The authenticator code can be received via network 110.

A signal indicating a scanned authenticator code is received at step 608. In various arrangements, the signal is received by device authenticator 106 from user device 104. In some arrangements, the scanned authenticator code signal includes data identifying a scanned code. In some embodiments, the data identifying a scanned code is used to confirm the selected device by comparing the scanned code with the displayed authenticator code, which may be performed by provider computing system 102. As will be described in greater detail with reference to FIG. 7, if it is determined that the data and the displayed authenticator code match, then the selected device is confirmed. Alternatively, if it is determined that the data and the displayed authenticator code do not match, then the selected device is not confirmed. Accordingly, if the selected device is not confirmed, then authentication operations for the device may stop. The scanned authenticator code can be received via network 110.

The scanned authenticator code signal is transmitted at step 610. In various arrangements, the scanned authenticator code signal is transmitted from device authenticator 106 to provider computing system 102. In various arrangements, the scanned authenticator code signal includes user information (e.g., identification, employee ID) associated with the user who selected the device. As will be described with reference to FIG. 7, the scanned authenticator code signal is used by provider computing system 102 to determine an authentication signal structured to enable one or more features of the user device 104 based on credentials of the user. In some arrangements, the scanned authenticator code signal can include device information such as device number, device type, storage location, etc. The scanned authenticator code signal can be transmitted via network 110.

An authentication signal is received at step 612. In various arrangements, the authentication signal is received by device authenticator 106 from provider computing system 102. In such arrangements, the authentication signal is received responsive to the transmitted scanned authenticator code signal. In general, the authentication signal provides information pertaining to an approval or rejection of authenticating a device. More specifically, the received authentication signal can include information such as one or more features to enable on a user device, verified employee identification associated with the authentication signal, device identification associated with the authentication signal, etc. The authentication signal can be received via network 110.

The selected device is authenticated based on the received authentication signal at step 614. In various arrangements, authenticating a device involves enabling one or more features (identified by the received authentication signal) provided by the device for use by the approved user. For example, assume authentication operations for a device structured as a mobile phone are being performed. Based on a received authentication signal, device authenticator 106 enables text messaging features and account management features but not social media features provided by the device. As such, the user for which the device is authenticated may use text messaging features and account management features. In various arrangements, authenticating a device involves enabling a countdown from a time period for which the device may be authenticated. Upon expiration of the time period, the device authentication expires, and the user is no longer able to access the features. Such a time period may be based on a shift length of the user, privileges of the user, responsibilities of the user, type of device, role of the user, etc. For example, a user is scheduled for a split shift between a front desk teller position for 3 hours and a drive-thru teller position for 5 hours. As part of the front desk teller position responsibilities, the user is to use a tablet device to conduct financial services for patrons. Accordingly, the tablet device is authenticated for use by the user for the 3 hour front desk teller portion of the user's shift.

Authenticated device information is transmitted at step 616. In various arrangements, the authenticated device information is transmitted from device authenticator 106 to provider computing system 102. Such information may include user identification associated with the authenticated device, authenticated device information, confirmation of authentication, period for which the device is authenticated, etc. The transmitted authenticated device information may be stored and used for a variety of reasons such as auditing purposes, device maintenance, software updates/maintenance, etc.

Figure 7:
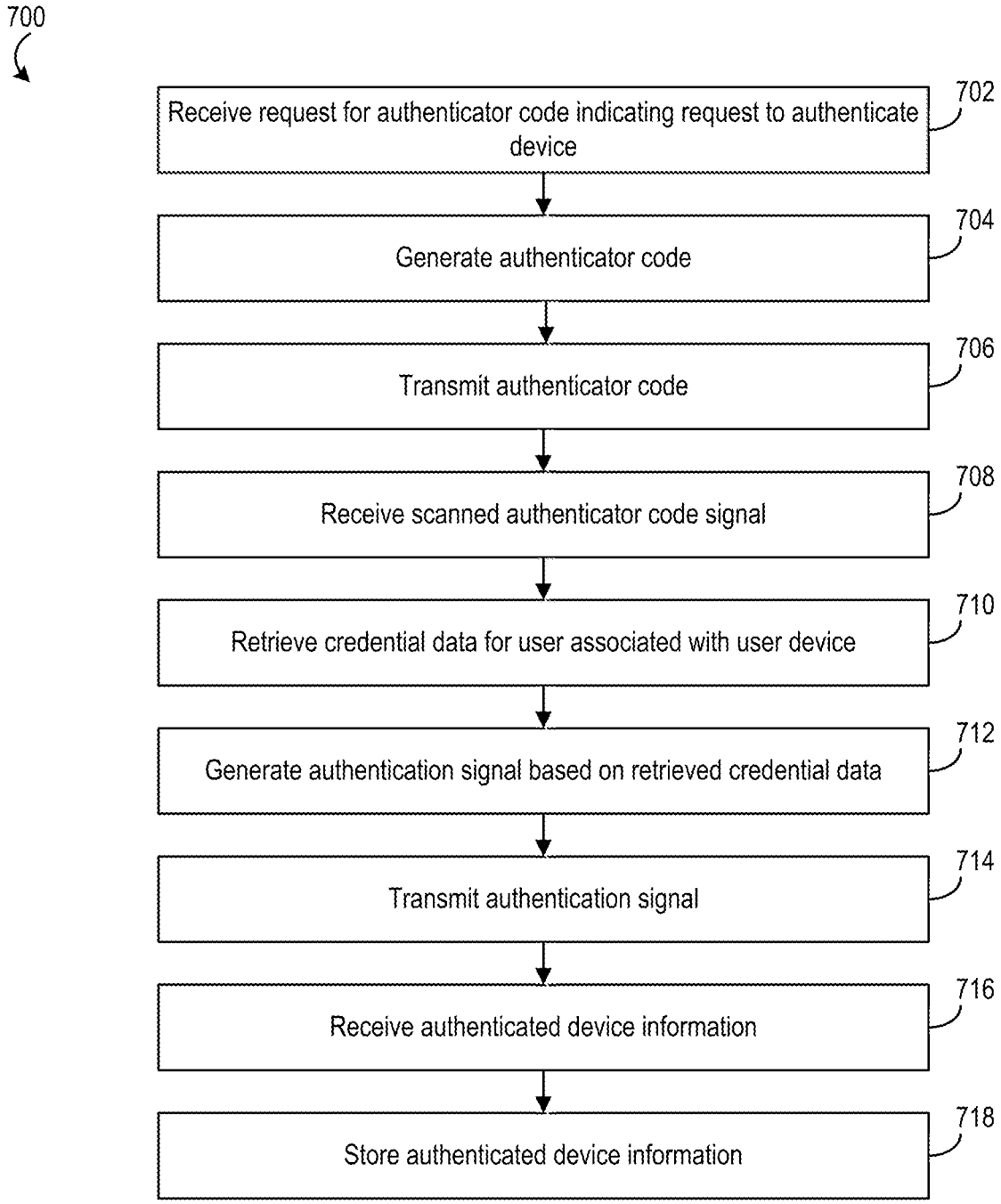
FIG. 7 is a flowchart depicting a method for determining an authentication decision, according to an example embodiment.

Referring now to FIG. 7, a method 700 for determining an authentication decision is shown, according to an example embodiment. In various embodiments, the method 700 is performed by the components of system 100 shown in FIG. 1 such that reference may be made to components of FIG. 1 to aid the description of method 300. In some arrangements, through the method 300, the provider computing system 102 receives a request for an authenticator code which indicates a request to authenticate a device (e.g., user device 104), generates and transmits the authenticator code to device authenticator 106, receives a scanned authenticator code signal (e.g., from device authenticator 106), retrieves credential data for a user associated with the device to generate and transmit an authentication signal, and receives and stores information about the authenticated device. In various arrangements, the method 300 is performed by provider computing system 102 in communication with device authenticator 106. Accordingly, process 700 may be performed by provider computing system 102 in time with process 600 performed by device authenticator 106. An exemplary implementation of the method 700 may be similar to that as described with reference to method 600.

A request for an authenticator code indicating a request to authenticate a device is received at step 702. In general, the request for an authenticator code indicates a request for authentication of a device. In various arrangements, the request is received by provider computing system 102 from device authenticator 106. In some arrangements, the request includes information of the device to be authenticated. In this regard, information about the device such as device number, device name, device type, etc. can be received as part of the request. In various arrangements, the request includes user information (e.g., identification, employee ID, shift) of the user who selected the device. The request for an authenticator code can be received via network 110.

The authenticator code is generated at step 704. In general, the authenticator code is structured as a confirmation code to be scanned or inputted via the device for authentication and used to confirm that the device which scanned or inputted the authenticator code is the same device which was previously selected by a user. In various arrangements, the authenticator code is generated by retrieving a pre-generated authenticator code stored by provider computing system 102. In other embodiments, the authenticator code is dynamically generated upon receiving the authenticator code request. In this regard, the authenticator code is a unique code that is different than one or more previously-generated authenticator codes. The authenticator code can include any type of code, characters, or pictures used to authenticate a device. For example, the authenticator code may be generated as a QR code. In some embodiments, a predetermined time period (e.g., 30 seconds, 1 minute) for which the authenticator code is valid is determined. Accordingly, upon expiration of the time period, the authenticator is deemed invalid and may be not be used for authentication operations.

The authenticator code is transmitted 706. In various arrangements, the authenticator code is transmitted to device authenticator 106 by provider computing system 102. The authenticator code may be transmitted via network 110. The transmitted authenticator code may be displayed by device authenticator 106. In some embodiments, a countdown form the predetermined time period for which the authenticator code is valid commences. In this regard, upon expiration of the countdown, the authenticator code may not be used to authenticate a device and is deem invalid.

A scanned authenticator code signal is received 708. In various arrangements, the scanned authenticator code is received by provider computing system 102 from device authenticator 106. In general, the scanned authenticator code signal indicates that the previously-generated code was scanned or inputted by a device. In some embodiments, the scanned authenticator code signal includes a device identification of the device which scanned or inputted the device. In various arrangements, the scanned code is used to confirm the selected device by comparing the scanned code with the previously-generated authenticator code. For example, a QR code is generated and transmitted to device authenticator code responsive to a request for an authenticator code. Accordingly, a scanned authenticator code signal comprising a QR code is received. The QR code associated with the scanned authenticator code signal is compared to the previously-generated QR code to determine if the two codes are the same. If it is determined that the two codes are the same, the authentication operations may proceed. If it is determined that the two codes are not the same, then authentication operations may cease. In various arrangements, the device identification received with the scanned authenticator code signal is compared to the device information which was received with request for an authenticator code to confirm that the device which scanned the authenticator code is the same as the device with which the request was associated. If it is determined that the device identifications match, then the device is confirmed and authentication operations may proceed. Alternatively, if it is determined that the device identifications do not match, then the device is not confirmed and authentication operations for the device may stop. The scanned authenticator code can be received via network 110.

Credential data for the user identified with the request for an authenticator code is retrieved at step 710. In various arrangements, the credential data is retrieved from workforce database 126. Retrieved credential data may include information such as employee role, responsibilities, privileges, restrictions, etc. which may be used to determine one or more features which the identified user may use on the device. In various arrangements, the credential data is used to confirm that the identified user is permitted to use the type of device for which authentication operations are performed. For example, a user may attempt to authenticate a mobile phone for use during his/her shift. However, based on the retrieved credentials for the user indicating that the user is not permitted to use a mobile phone (e.g., the employee role of the user does not permit the use of a mobile phone, the responsibilities of the user do not require the use of a mobile phone, the user is restricted from using a mobile phone). As such, the mobile phone is not authenticated, and authentication operations may stop. In this regard, the attempt by the user to authenticate a type of device which he/she is not permitted to use may be reported to a managerial position. As will be described, the retrieved credential data is used to determine an authentication decision for the device.

The authentication signal is generated based on the retrieved credential data at step 712. In some arrangements, the authentication signal is generated by the provider computing system 102. In various arrangements, generating the authentication signal involves determining an authentication decision based on the retrieved credentials. In general, an authentication decision indicates an approval or rejection of authenticating a device, one or more features which may be enabled on the device, a time period for which the device is authenticated, etc. Accordingly, determining an authentication decision may involve analyzing the retrieved credential data to determine whether the device may be authenticated for the user, one or more features provided by the device that may be enabled for use by the user, and a time period for which the device may be authenticated. For example, a first mobile phone may be authenticated for use by a manager for an 8 hour period. Based on the credentials of the manager, the enabled features may include cash drawer accessibility, vault accessibility, supplies closet accessibility, etc. In another example, a second mobile phone may be authenticated for use by a teller for a 6 hours period. Based on the credentials of the teller, the enabled feature may include cash drawer accessibility. As such, the authentication signal including the authentication decision is generated.

The authentication signal is transmitted at step 714. In some arrangements, the authentication signal is transmitted to device authenticator 106 by provider computing system 102. In various arrangements, the authentication signal includes an authentication decision indicating an approval or rejection of authentication a device, one or more features which may be enabled on the device, a time period for which the device is authenticated, etc. The transmitted authentication signal may be interpreted by device authenticator to authenticate a device in accordance with the authentication decision associated therewith. In various arrangements, the authentication signal is transmitted via network 110.

Authenticated device information is received at step 716. In some arrangements, the authenticated device information is transmitted to provider computing system 102 from device authenticator 106. Authenticated device information may include information such as user identification associated with the authenticated device, authenticated device identification, confirmation of authentication, period for which the device is authenticated, enabled features, etc. Accordingly, the authenticated device information is stored at step 718. Such information may be stored in authentication database 124.

Figure 8:
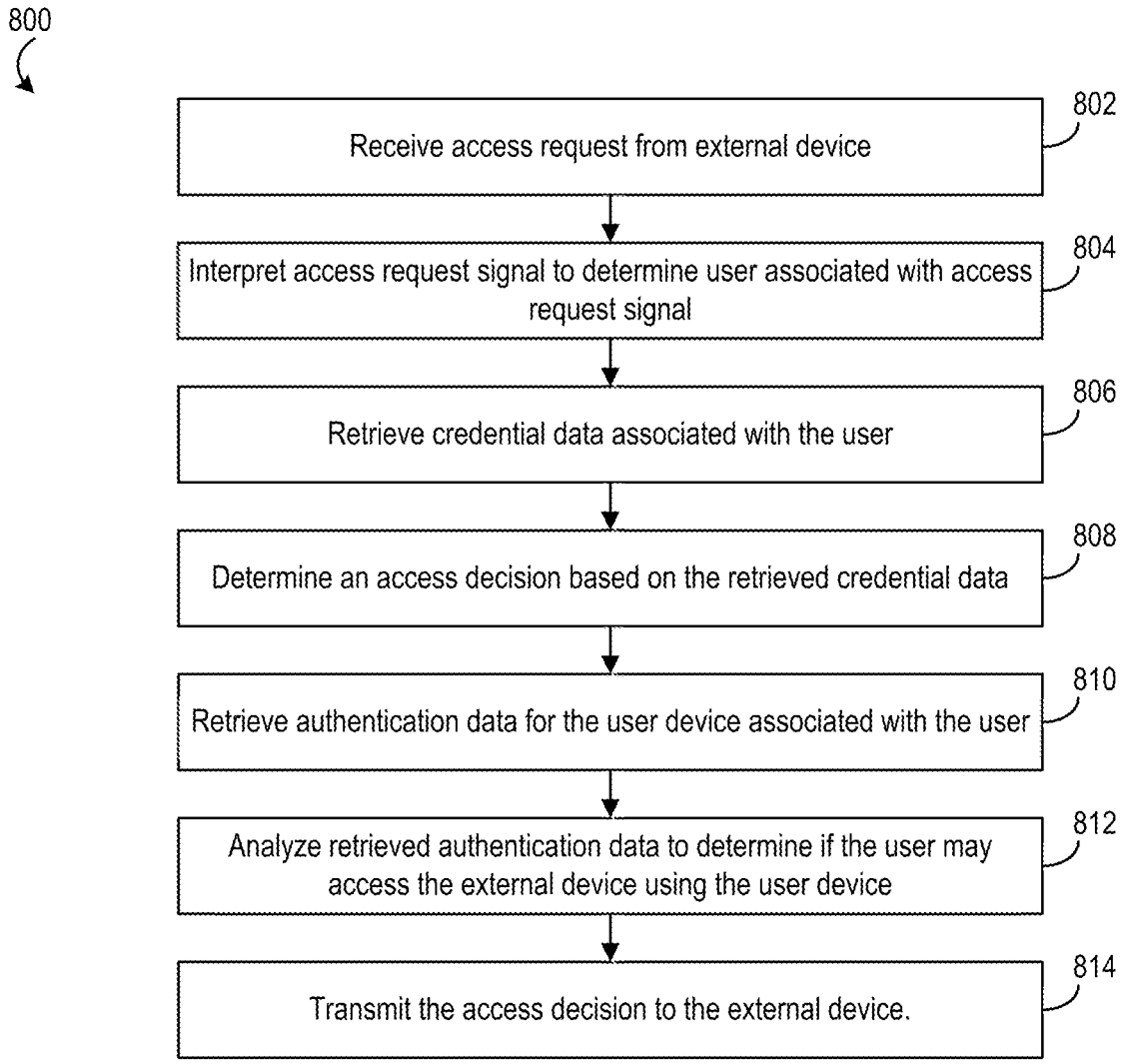
FIG. 8 is a flowchart depicting a first method for accessing an external device, according to an example embodiment.

Referring now to FIG. 8, a method 800 for determining an access decision is shown, according to an example embodiment. In general, an access decision is an instruction that permits or denies a user access to a device (e.g., external device 108). As will be described, the method 800 to determine an access decision may be triggered without user interaction with the external device or a user device in communication with the external device. Alternatively, the method 800 to determine an access decision may be triggered with user interaction (indicating an access request to the external device) with the external device or a user device in communication with the external device. In various embodiments, the method 800 is performed by the components of system 100 shown in FIG. 1 such that reference may be made to components of FIG. 1 to aid the description of method 400. In some arrangements, through the method 800, the provider computing system 102 receives an access request from an external device, interprets the access request to determine a particular user device and the user associated therewith, retrieves credential data of the user, determines an access decision based on the retrieved credential data, retrieves authentication data for the user device, determines an identification of the particular user device, and transmits the access decision to the determined external device.

An exemplary implementation of the method 800 is a FI branch location including employees working to perform financial services provided by the corresponding FI to patrons of the branch location. An employee may need to access a vault, which is locked and secured by a door, to balance the vault, retrieve cash, deposit cash, etc. Upon approaching the vault door structured as external device 108, the external device 108 detects the presence of the user upon the user entering a predetermined region associated with the vault door. Such presence detection may be facilitated by the proximity signal transmitter 138 of user device 104 emitting a proximity signal that is received by the proximity sensor 166 of external device 108. As such, external device 108 transmits an access request to provider computing system 102 and provides user information and user device information from which the proximity signal was received. In turn, provider computing system uses the user information and user device information to determine an access decision (e.g., allow access, deny access). Accordingly, the access decision is transmitted to external device 108 to perform an access action based on the access decision.

An access request is received at step 802. In some arrangements, the request is received by provider computing system 102 from external device 108. In general, the access request is a request to determine an access decision that allows or denies a particular user access to external device 108. The received access request may include user information such as a user identification for the particular user and user device information such as a device identification for which the particular user is authenticated to use. For example, the received access request may include information such as an employee identification number of the particular user.

The received access request is interpreted to determine a user (e.g., a user identification) associated with the access request at step 804. In some arrangements, the received access request is interpreted by provider computing system 102. The user may be determined by retrieving a user identification stored in workforce database 126 using an employee identification number. The user identification may be used to retrieve credential data associated with the user. Credential data associated with the identified user is retrieved at step 806. In various arrangements, provider computing system 102 retrieves the credential data stored in workforce database 126. Credential data that is retrieved may include employee role, responsibilities, privileges, restrictions, etc. As will be described, the retrieved credential data is used to determine an access decision.

An access decision is determined based on the retrieved credential data at step 808. In various arrangements, the access decision is determined by provider computing system 102. In general, determining an access decision involves analyzing the retrieved credential data to determine if the user for which the credential data was retrieved is permitted to access the device which transmitted the access request. Accordingly, the access decision is an instruction comprising a decision whether the associated user is allowed to access the device or is not allowed to access the device. Such a decision may be based on employee role (e.g., manager, teller, receptionist), employee responsibilities (e.g., withdrawal transactions, deposit transactions, answering phones, opening accounts), employee restrictions, etc. For example, an access decision for a manager requesting access to a vault may allow the manager access to the vault due the employee role. In another example, an access decision for a receptionist requesting to a vault may not allow the receptionist access to the vault based on the employee responsibilities. In arrangements which the access decision denies access to the device, access operations described herein may not be performed.

Authentication data for the user device associated with the user is retrieved at step 810. In general, the authentication data is retrieved to determine that the authenticated device via which the user is requesting access is authenticated and enabled to perform access operations. For example, an access request (as described with reference to step 802) requesting access to a vault was transmitted based on a received proximity signal emitted by a laptop. An access decision allowing access to the vault was determined based on the credentials of the user associated with the laptop. However, the laptop is not enabled to perform access operations. Accordingly, the access operations cease and the user is denied access to the vault. Retrieved authentication data may include information such as the one or more features enabled on the authentication device, time period of the authentication, etc.

The retrieved authentication data is analyzed to determine if the user may access the external device using the user device at step 812. More specifically, the retrieved authentication data is analyzed to determine if one of the one or more enabled features (which may be enabled as part of the authentication processes described with reference to FIGS. 6 and 7) is a feature with which the user may access external devices. In various arrangements, the retrieved authentication data is analyzed by provider computing system 102. If the device is determined to not be an authenticated device, then access operations may stop. For example, if the retrieved authentication data indicates that a particular device is not authenticated to participate in access operations, then the access decision is not transmitted to the external device. Alternatively, if it is determined that the device is an authenticated device, then access operations may proceed.

At step 814, the access decision is transmitted to the external device responsive to determining that the user may use the user device to access the external device. In various arrangements, the access decision is transmitted by provider computing system 102 to external device 108. In various arrangements, the access decision is an instruction comprising a decision whether the associated user is allowed to access the device or is not allowed to access the device. In some arrangements, the decision is an approval of access to the external device by the user. In other arrangements, the decision is a denial of access to the external device by the user.

Figure 9:
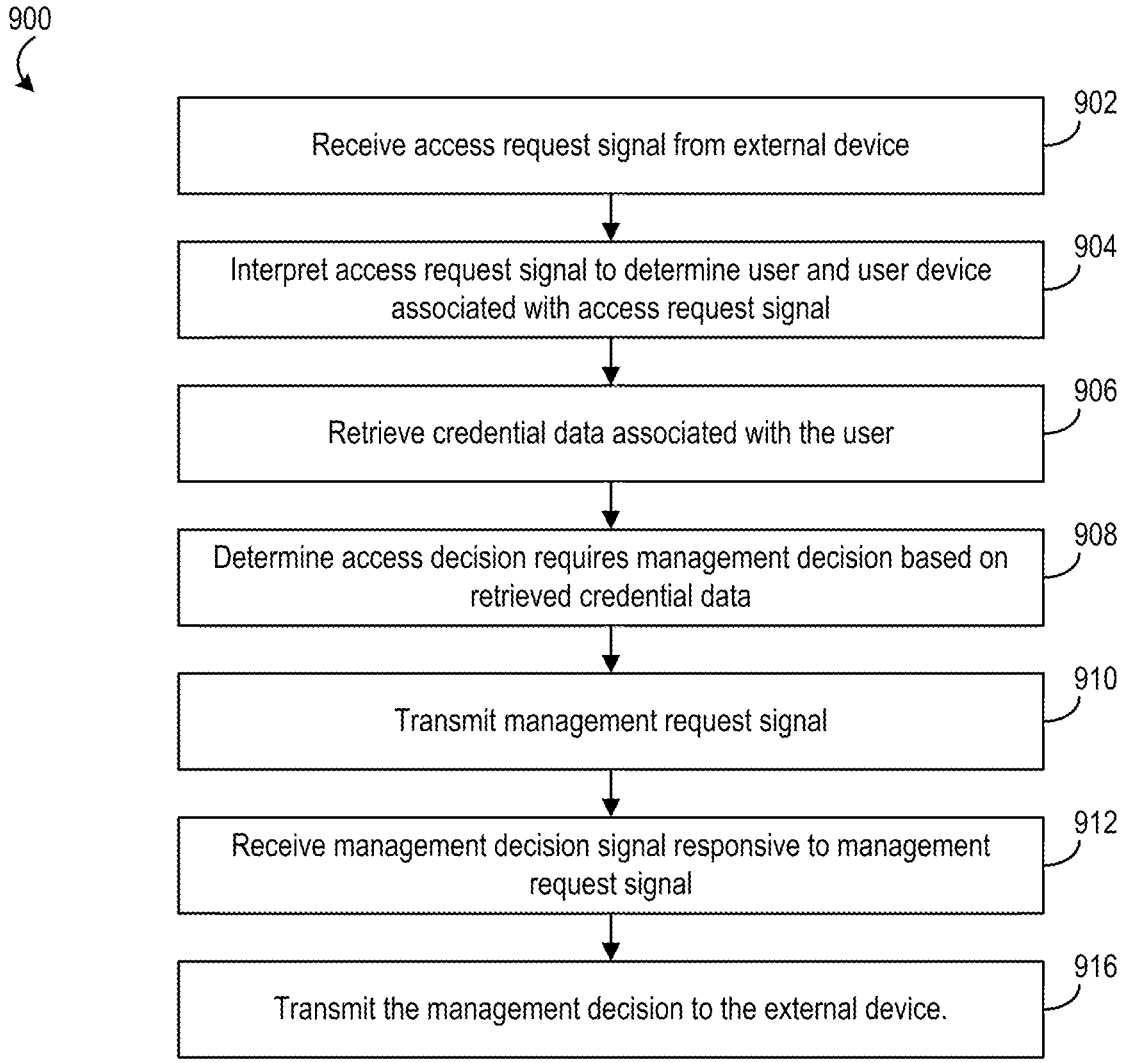
FIG. 9 is a flowchart depicting a second method for accessing an external device, according to an example embodiment.

Referring now to FIG. 9, a method 900 for determining an access decision based on a management decision is shown, according to an example embodiment. In various embodiments, the method 900 is performed by the components of system 100 shown in FIG. 1 such that reference may be made to components of FIG. 1 to aid the description of method 900. In some arrangements, through the method 900, the provider computing system 102 receives an access request from an external device, interprets the access request to determine a particular user device and the user associated therewith, retrieves credential data of the user, determines the access decision requires a management decision, receives a management decision, and interprets the management decision to determine the access decision. An exemplary implementation of method 900 may be similar to that as described with reference to FIG. 8. Step 902-step 906 may similar to that as described with reference to step 802-step 806 of FIG. 8.

At step 908, it is determined that the retrieved credentials of the user requires management personnel to determine the access decision for the user. In general, a management decision may be required for a user whose credentials do not satisfy the required credentials for accessing a particular device. Various examples of credentials that do not satisfy the required credentials include an employee role that does not allow the user to access a particular external device, the user is on employee probation, the external device requires manager presence while the user accesses the external device, etc. As such, an employee having management status may be required to provide a decision associated for the access request.

At step 910, a management request signal is transmitted. In various arrangements, the management request signal is transmitted from provider computing system 102 to a device associated with a person of management authority. Such a device may be an authenticated device that is authenticated for use by the person of management authority. Alternatively, the management request can be sent in the form of a message that is transmitted via a messaging service (e.g., email, text messaging) to an account associated with the person of management authority. For example, the management request may send a link to an email address of the person of management authority. The management request may request verification of the person of management authority. Such verification may be facilitated by requesting an employee ID number, employee PIN, biometric data, a password, etc. For example, upon receiving the management request, the person of management authority is required to input an employee PIN before accessing the management request. In various arrangements, the management request provides one or more selection options that the person of management authority may select in response to the management request. The various selection options may include allow access, deny access, allow access with management presence, allow access for a predetermined amount of time, etc.

A management decision signal including the management decision responsive to the transmitted management request signal is received at step 912. In various arrangements, the management decision is transmitted from a device associated with a person of management authority to provider computing system 102. Provider computing system 102 analyzes the management decision signal to determine the management decision. The management decision may depend on the selection options provided with the management decision request. Various examples of management decisions include allow access, deny access, allow access with management presence, allow access to device for 2 minutes, etc. Accordingly, upon determining the management decision, the management decision is transmitted by provider computing system 102 to external device 108 at step 916.

Figure 10:
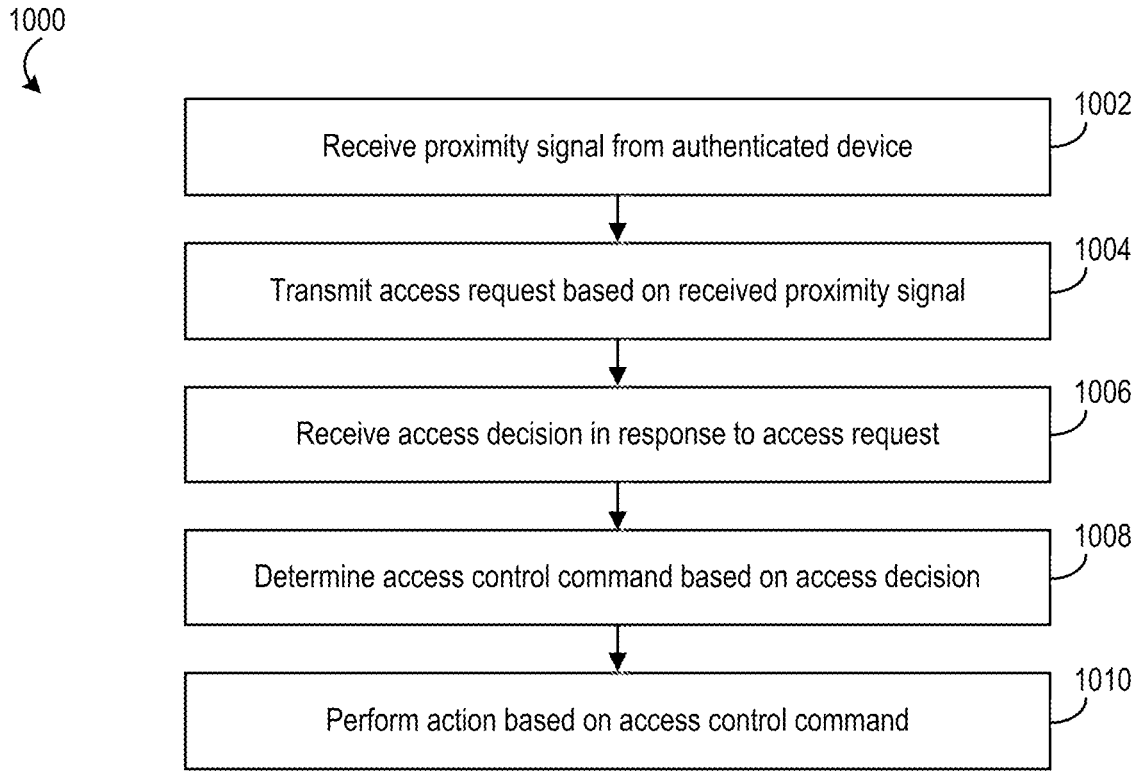
FIG. 10 is a flowchart depicting a method of using an access decision to access an external device, according to an example embodiment.

Referring now to FIG. 10, a method 1000 for requesting an access decision and determining an access control command based on the access decision is shown, according to an example embodiment. In various embodiments, the method 1000 is performed by the components of system 100 shown in FIG. 1 such that reference may be made to components of FIG. 1 to aid the description of method 900. In some arrangements, through the method 1000, the external device 108 receives a proximity signal from an authenticated device, transmits an access request based on the proximity signal, receives an access decision responsive to the access request, and determines an access control command based on the access decision. An exemplary implementation of method 1000 may be similar to that as described with reference to FIG. 8.

A proximity signal is received from an authenticated device at step 1002. In some embodiments, the proximity signal is received by external device 108 from user device 104. In some arrangements, user information and user device information is received as part of the proximity signal. In some arrangements, the proximity signal is transmitted upon user device 104 entering a predetermined region associated with external device 108. Such a proximity signal may be transmitted automatically. Alternatively, the proximity signal is transmitted upon receiving a user input. For example, a user may press a selection option that transmits the proximity signal. In various arrangements, the proximity signal establishes communication via a proximity network (e.g., proximity communication 111) between user device 104 and external device 108 such that information may be transmitted between the user device 104 and the external device 108. In various arrangements, the proximity signal indicates that the user associated with the authenticated device is requesting access to the external device.

An access request is transmitted based on the received proximity signal at step 1004. In some embodiments, the access request is transmitted from external device 108 to provider computing system 102. In general, the access request transmitted is a request for an access decision to external device 108 based on the credentials of a user. The access request may be transmitted automatically upon receiving the proximity signal. In some arrangement, the access request is transmitted upon receiving user input indicating the wishes to access the external device. For example, upon receiving the proximity signal, external device 108 transmits to user device 104 a selection option allowing for the user associated with user device 104 to select whether he/she requests access to external device 108. Accordingly, upon receiving a selection option indicating that the user is requesting access to external device 108, an access request is transmitted by external device 108 to provider computing system 102.

An access decision responsive to the transmitted access request is received at step 1006. The access decision may transmitted by provider computing system 102 and received by external device 108. As previously described, an access decision is an instruction comprising a decision whether the associated user is allowed to access the device or is not allowed to access the device. In various arrangements, the access decision is a decision allowing access to the external device 108. In such arrangements, various parameters or constraints may be implemented with the access decision. Examples of parameter or constraints may include an amount of time that the user may access external device 108, access is allowed based on the presence of a manager, etc. In various arrangements, the access decision is a decision denying access to the external device 108.

An access control command based on the access decision is determined at step 1008. In some embodiments, the access control command is determined by external device 108. In general, an access control command is a command that allows access by a user to one or more features (e.g., provided by external device 108) or denies access to such a used. In various arrangements, determining an access control command involves analyzing the access decision to determine the particular features to allow access to by the user. In such arrangements, the access control command may not allow access to all features provided by the external device 108. For example, assume external device 108 is a computer-controlled cash drawer. Based on a first access decision for a first user, the first user may be allowed access to use the computer but denies access to the cash drawer. Based on a second access decision for a second user, the second used may be allowed access to use the computer and the access to the cash drawer. Accordingly, an action is performed based on the access control command at step 1010. In various arrangements, the action is performed by external device 108. An example of an action includes unlocking a vault door based on the access control command, thereby allowing access to the vault. Another example of an action control command is to lock a vault door based on the access control command, thereby denying access to the vault.

Figure 11:
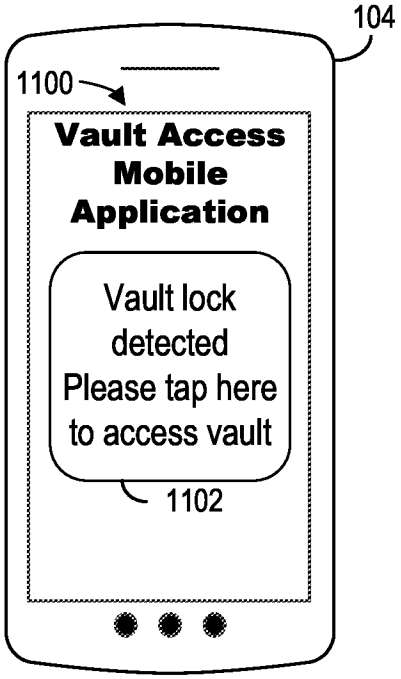
FIG. 11 is a schematic drawing depicting an example user interface of the user device used in the environment of FIG. 1, according to an example embodiment.

Referring generally to FIGS. 11-14, various example user interfaces as can be generated by user device 104 are shown, according to various example embodiments. The example user interfaces as shown in FIGS. 11-14 illustrate various user interfaces that are presented to a user that is requesting access to a device (e.g., external device 108) structured as a vault door. Referring specifically to FIG. 11, a first example user interface 1100 as generated by user device 104 is shown, according to an example embodiment. The first example user interface 1100 provides an example interface of information displayed to a user that is approaching an external device 108. As previously described, in various arrangements, user input may be required in order to transmit an access request. As such, first example user interface 1100 generates a selection button 1102 allowing the user to select whether he or she wishes to transmit an access request. Upon selection of the selection button 1102, an access request may be transmitted from external device 108 to provider computing system 102.

Figure 12:
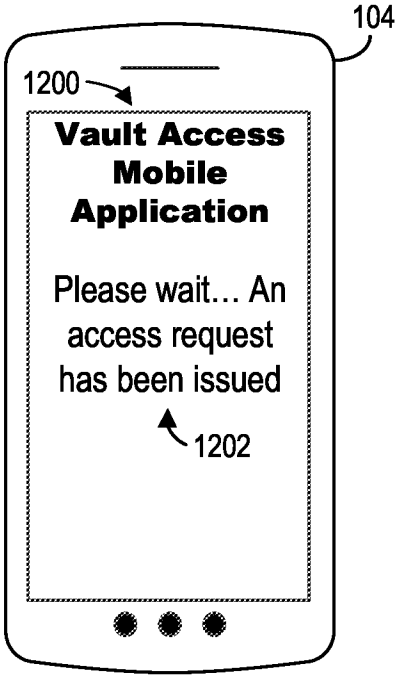
FIG. 12 is a schematic drawing depicting another example user interface of the user device used in the environment of FIG. 1, according to an example embodiment.

Referring to FIG. 12, a second example user interface 1200 as generated by user device 104 is shown, according to an example embodiment. The second example user interface 1200 provides an example interface of information displayed to a user following the transmission of an access request (e.g., from external device 108 to provider computing system 102). In various arrangements, the second example user interface 1200 may be generated sequentially after a user has selected selection button 1102 (as described with reference to FIG. 11). Alternatively, the second example user interface 1200 may be generated automatically after communication via proximity communication 111 has been established between user device 104 and external device 108. Accordingly, second example user interface 1200 provides a notification 1202 indicating that an access request has been transmitted.

Figure 13:
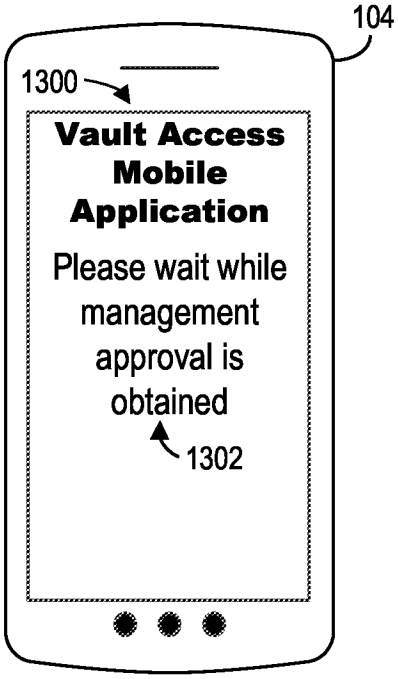
FIG. 13 is a schematic drawing depicting another example user interface of the user device used in the environment of FIG. 1, according to an example embodiment.

Referring to FIG. 13, a third example user interface 1300 as generated by user device 104 is shown, according to an example embodiment. The third example user interface 1300 provides an example interface of information displayed to a user following an access decision that requires a management decision (as was described with reference to method 900 of FIG. 9). Accordingly, third example user interface 1300 provides a notification 1302 indicating that the system (e.g., system 100) is waiting for a management approval.

Figure 14:
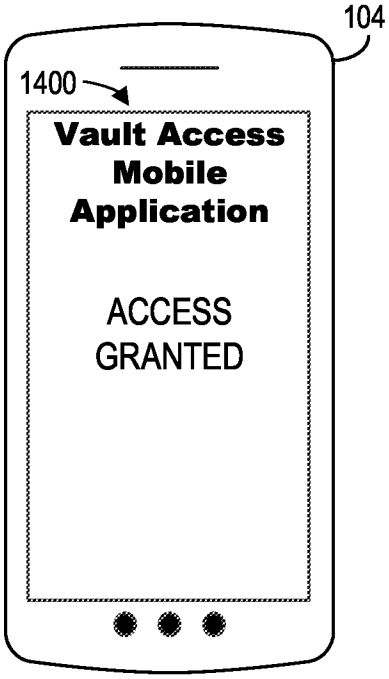
FIG. 14 is a schematic drawing depicting another example user interface of the user device used in the environment of FIG. 1, according to an example embodiment.

Referring now to FIG. 14, a fourth example user interface 1400 as generated by user device 104 is shown, according to an example embodiment. The fourth example user interface 1400 provides an example interface of information displayed to a user following an access decision allowing access by the user to external device 108. Accordingly, fourth example user interface 1400 provides a notification 1402 indicating that the user has been granted access to external device 108.

Referring generally to FIGS. 15-20, various example user interfaces as generated by external device 108 are shown, according to various example embodiments. The example user interfaces as illustrated in FIGS. 15-20 may be generated in accordance with, or alternatively to, the example user interface generated by user device 104 illustrated in FIGS. 11-14. Accordingly, the example user interfaces as shown in FIGS. 15-20 illustrate various user interfaces that are presented to a user that is requesting access to external device 108, which is structured as a vault door, according to an example embodiment.

Figure 15:
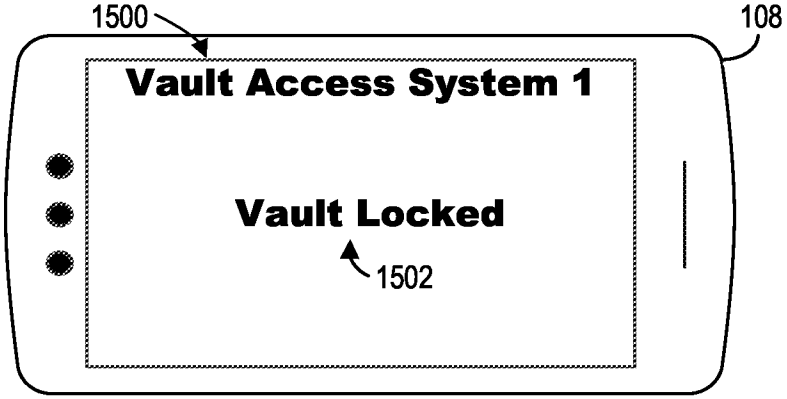
FIG. 15 is a schematic drawing depicting an example user interface of the external device used in the environment of FIG. 1, according to an example embodiment.

Referring specifically to FIG. 15, a first example user interface 1500 as generated by external device 108 is shown, according to an example embodiment. The first example user interface 1500 provides an example interface of information displayed to a user prior to approaching the external device 108. In some embodiments, the first example user interface 1500 is presented to a user that does not possess an authenticated device or does not possess the proper credentials to access external device 108. For example, a user that does not possess an authenticated user device 104 approaches external device 108. Accordingly, as previously described, communication via proximity communication 111 is not established between external device 108 and user device 104. As such, access request is not transmitted from external device 108 to provider computing system 102, and external device 108 generates first example user interface 1500. First example user interface presents a notification 1502 indicating that the vault is locked, thereby denying access to a user to the vault.

Figure 16:
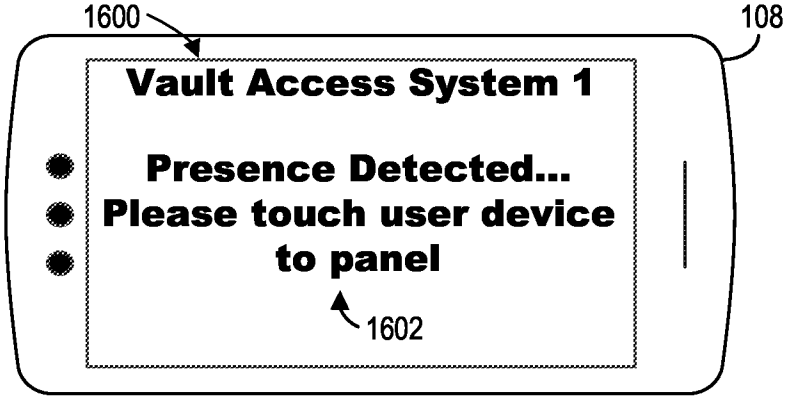
FIG. 16 is a schematic drawing depicting another example user interface of the external device used in the environment of FIG. 1, according to an example embodiment.

Referring now to FIG. 16, a second example user interface 1600 as generated by external device 108 is shown, according to an example embodiment. The second example user interface 1600 provides an example interface of information displayed to a user upon entering a predetermined region associated with external device 108. Accordingly, the second example user interface 1600 is an example interface that is displayed up establishing proximity communication between user device 104 and external device 108. The second example user interface 1600 is shown to display a notification 1602. Notification 1602 presents dialogue showing that the presence of user device 104 has been detected by external device 108. Notification 1602 also requests that the user device 104 be touched to external device 108. Such a request may commence access operations performed by external device 108. Such access operations performed by external device 108 are described with reference to method 1000.

Figure 17:
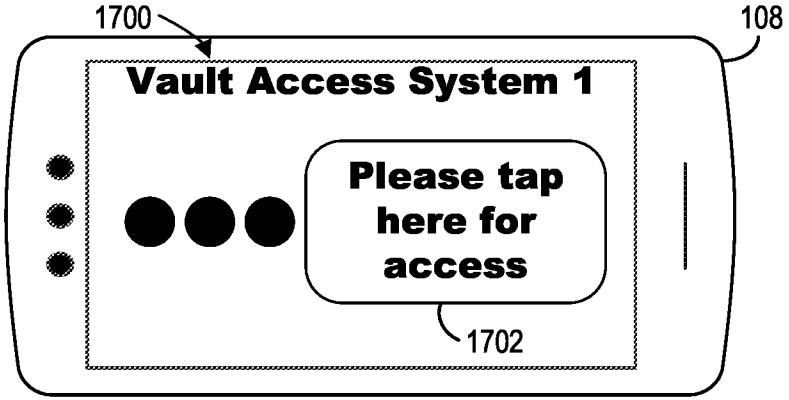
FIG. 17 is a schematic drawing depicting another example user interface of the external device used in the environment of FIG. 1, according to an example embodiment.

Referring now to FIG. 17, a third example user interface 1700 as generated by external device 108 is shown, according to an example embodiment. Third example user interface 1700 provides another example interface of information displayed to a user upon entering a predetermined region associated with external device 108. The third example user interface 1700 is shown to display a selection option 1702. Selection option 1702 presents dialogue requesting the user to tap selection option 1702 in order to access external device 108. Upon tapping selection option 1702, access operations may be performed by external device 108. Such access operations performed by external device 108 are described with reference to method 1000.

Figure 18:
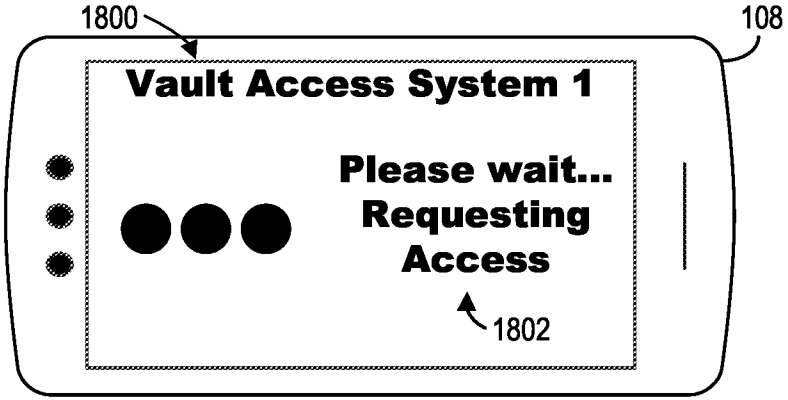
FIG. 18 is a schematic drawing depicting another example user interface of the external device used in the environment of FIG. 1, according to an example embodiment.

Referring now to FIG. 18, a fourth example user interface 1800 as generated by external device 108 is shown, according to an example embodiment. Fourth example user interface 1800 provides another example interface of information displayed to a user. In various arrangements, fourth example user interface 1800 may be generated immediately after proximity communication is established between external device 108 and user device 104. Alternatively, fourth example user interface 1800 is generated after receiving, by external device 108, a user input. Such a user input may include tapping a selection option (e.g., selection option 1702) or tapping user device 104 to external device 108. Fourth example user interface 1800 provides a notification 1802 indicating that the external device 108 has requested access. More specifically, the notification 1802 indicates that the external device 108 has transmitted an access request to provider computing system 102.

Figure 19:
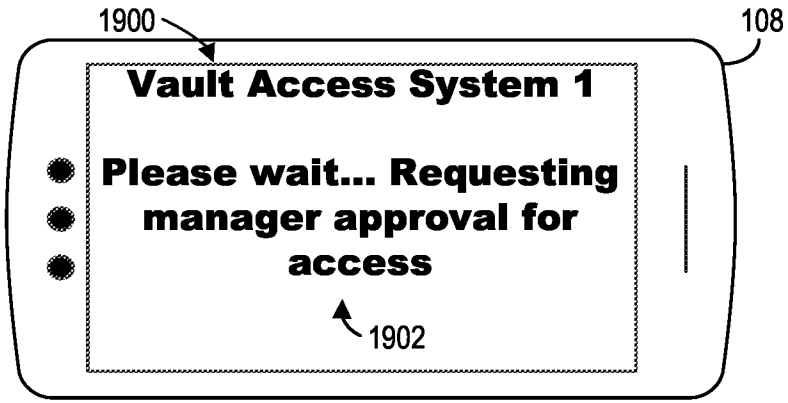
FIG. 19 is a schematic drawing depicting another example user interface of the external device used in the environment of FIG. 1, according to an example embodiment.

Referring now to FIG. 19, a fifth example user interface 1900 as generated by external device 108 is shown, according to an example embodiment. In various arrangements, fifth example user interface 1900 is generated upon provider computing system 102 transmitting a management request to a device associated with a person of management authority. Accordingly, provider computing system 102 communicates with external device 108 to display a notification 1902. Notification 1902 presents dialogue indicating that a request for manager approval for access to external device 108 has been requested.

Figure 20:
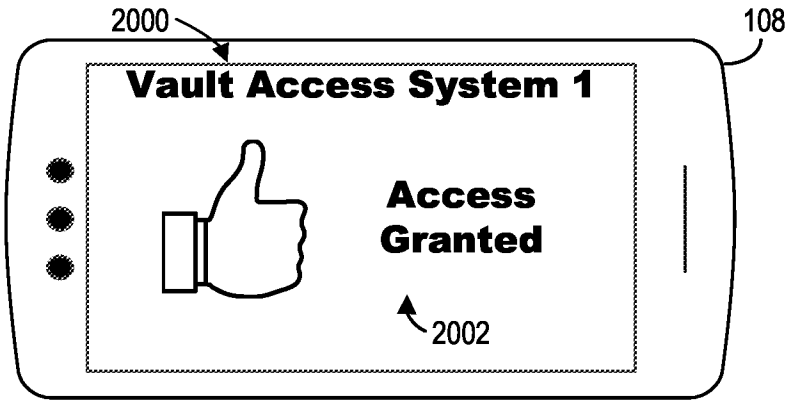
FIG. 20 is a schematic drawing depicting another example user interface of the external device used in the environment of FIG. 1, according to an example embodiment.

Referring now to FIG. 20, a sixth example user interface 2000 as generated by external device 108 is shown, according to an example embodiment. Sixth example user interface 20000 provides another example interface of information displayed to a user. Sixth example user interface 2000 may be generated upon external device 108 receiving an access decision allowing access by the user to external device 108. Accordingly, user interface 2000 provides a notification 2002 indicating the access to external device 108 has been granted.

The embodiments described herein have been described with reference to drawings. The drawings illustrate certain details of specific embodiments that implement the systems, methods and programs described herein. However, describing the embodiments with drawings should not be construed as imposing on the disclosure any limitations that may be present in the drawings.

It should be understood that no claim element herein is to be construed under the provisions of 35 U.S.C. § 112(f), unless the element is expressly recited using the phrase "means for."

As used herein, the term "circuit" may include hardware structured to execute the functions described herein. In some embodiments, each respective "circuit" may include machine-readable media for configuring the hardware to execute the functions described herein. The circuit may be embodied as one or more circuitry components including, but not limited to, processing circuitry, network interfaces, peripheral devices, input devices, output devices, sensors, etc. In some embodiments, a circuit may take the form of one or more analog circuits, electronic circuits (e.g., integrated circuits (IC), discrete circuits, system on a chip (SOCs) circuits, etc.), telecommunication circuits, hybrid circuits, and any other type of "circuit." In this regard, the "circuit" may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on).

The "circuit" may also include one or more dedicated processors communicatively coupled to one or more dedicated memory or memory devices. In this regard, the one or more processors may execute instructions stored in the memory or may execute instructions otherwise accessible to the one or more processors. In some embodiments, the one or more processors may be embodied in various ways. The one or more processors may be constructed in a manner sufficient to perform at least the operations described herein. In some embodiments, the one or more processors may be shared by multiple circuits (e.g., circuit A and circuit B may comprise or otherwise share the same processor which, in some example embodiments, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. Each processor may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor, etc.), microprocessor, etc.

An example system for implementing the overall system or portions of the embodiments might include a general purpose computing computers in the form of computers, including a processing unit, a system memory, and a system bus that couples various system components including the system memory to the processing unit. Each memory device may include non-transient volatile storage media, non-volatile storage media, non-transitory storage media (e.g., one or more volatile and/or non-volatile memories), etc. In some embodiments, the non-volatile media may take the form of ROM, flash memory (e.g., flash memory such as NAND, 3D NAND, NOR, 3D NOR, etc.), EEPROM, MRAM, magnetic storage, hard discs, optical discs, etc. In other embodiments, the volatile storage media may take the form of RAM, TRAM, ZRAM, etc. Combinations of the above are also included within the scope of machine-readable media. In this regard, machine-executable instructions comprise, for example, instructions and data which cause a general purpose computer, special purpose computer, or special purpose processing machines to perform a certain function or group of functions. Each respective memory device may be operable to maintain or otherwise store information relating to the operations performed by one or more associated circuits, including processor instructions and related data (e.g., database components, object code components, script components, etc.), in accordance with the example embodiments described herein.

It should also be noted that the term "input devices," as described herein, may include any type of input device including, but not limited to, a keyboard, a keypad, a mouse, joystick or other input devices performing a similar function. Comparatively, the term "output device," as described herein, may include any type of output device including, but not limited to, a computer monitor, printer, facsimile machine, or other output devices performing a similar function.

Any foregoing references to currency or funds are intended to include fiat currencies, non-fiat currencies (e.g., precious metals), and math-based currencies (often referred to as cryptocurrencies). Examples of math-based currencies include Bitcoin, Litecoin, Dogecoin, and the like.

It should be noted that although the diagrams herein may show a specific order and composition of method steps, it is understood that the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative embodiments. Accordingly, all such modifications are intended to be included within the scope of the present disclosure as defined in the appended claims. Such variations will depend on the machine-readable media and hardware systems chosen and on designer choice. It is understood that all such variations are within the scope of the disclosure. Likewise, software and web implementations of the present disclosure could be accomplished with standard programming techniques with rule based logic and other logic to accomplish the various database searching steps, correlation steps, comparison steps and decision steps.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

What is claimed is:

1. A computing system comprising a processing circuit comprising a processor and memory, the processing circuit structured to approve or deny access to a secured device, the processing circuit configured to:

receive, from the secured device responsive to the secured device detecting a proximity signal from a user device, an access request comprising (i) an indication that the user device is proximate to the secured device and (ii) an identifier of the user device;

identify, based on the access request, a user associated with the user device;

retrieve authentication data corresponding to the user device identified in the access request received from the secured device;

retrieve credential data corresponding to the user identified based on the access request received from the secured device;

identify a plurality of enabled features of the secured device;

select, based on at least one of the authentication data or the credential data, a subset of the plurality of enabled features of the secured device that the user device is authorized to access; and transmit an authentication message comprising identifiers of each of the subset of the plurality of enabled features to the secured device, causing the secured device to provide the user device access to the subset of the plurality of enabled features of the secured device.

2. The computing system of claim 1, wherein the computing system is coupled with a device authenticator structured to authenticate the user device based on an authentication signal generated by the computing system.

3. The computing system of claim 2, wherein the processing circuit is configured to generate the authentication signal to allow one or more privileges to the user device based on the retrieved credential data.

4. The computing system of claim 3, wherein the processing circuit is configured to receive a request for an authenticator code and retrieve the authenticator code from an authentication database.

5. The computing system of claim 3, wherein the processing circuit is configured to generate the authentication signal responsive to receiving a scanned authenticator code signal.

6. The computing system of claim 1, wherein the processing circuit is further configured to transmit a management request signal to a management device based on the retrieved credential data.

7. The computing system of claim 6, wherein the processing circuit is configured to receive a management decision signal from the management device in response to the management request signal, wherein the management decision signal indicates an access grant decision or an access deny decision.

8. A computer-implemented method, comprising:

receiving, by a computing system, an access request from a secured device responsive to the secured device detecting a proximity signal from a user device, the access request comprising (i) an indication that the user device is proximate to the secured device and (ii) an identifier of the user device;

identifying, by the computing system, a user associated with the user device based on the access request;

retrieving, by the computing system, authentication data corresponding to the user device identified in the access request received from the secured device;

retrieving, by the computing system, credential data corresponding to the user identified based on the access request received from the secured device;

identifying, by the computing system, a plurality of enabled features of the secured device;

selecting, by the computing system, based on at least one of the authentication data or the credential data, a subset of the plurality of enabled features of the secured device that the user device is authorized to access; and transmitting, by the computing system, an authentication message comprising identifiers of each of the subset of the plurality of enabled features to the secured device, causing the secured device to provide the user device access to the subset of the plurality of enabled features of the secured device.

9. The computer-implemented method of claim 8, further comprising receiving, by the computing system, a request for an authenticator code from a device authenticator and retrieving the authenticator code from an authentication database.

10. The computer-implemented method of claim 9, further comprising receiving, by the computing system, a scanned authenticator code responsive to transmitting the authenticator code to the device authenticator.

11. The computer-implemented method of claim 10, further comprising generating an authentication signal structured to allow one or more privileges to the user device based on retrieved credential data responsive to receiving the scanned authenticator code.

12. The computer-implemented method of claim 11, further comprising transmitting the authentication signal to the device authenticator structured to authenticate the user device based on the authentication signal.

13. The computer-implemented method of claim 8, further comprising transmitting a management request signal to a management device based on the retrieved credential data.

14. The computer-implemented method of claim 13, further comprising receiving a management decision signal from the management device in response to the management request signal, wherein the management decision signal indicates an access grant decision or an access deny decision.

15. A secured device, comprising:

a proximity sensor structured to detect user devices in proximity of the secured device;

a network interface structured to facilitate data communication via a network;

a processing circuit comprising a processor and memory, the processing circuit structured to:

detect, via the proximity sensor, a proximity signal indicating a user device is located within a predetermined distance of the secured device; and transmit an access request to a computing system responsive to detecting the proximity signal from the user device, causing the computing system to:

identify, based on the access request, a user corresponding to the user device;

retrieve authentication data corresponding to the user device identified in the access request received from the secured device;

retrieve credential data corresponding to the user identified based on the access request;

identify a plurality of enabled features of the secured device;

select, based on at least one of the authentication data or the credential data, a subset of the plurality of enabled features of the secured device that the user device is authorized to access; and transmit an authentication message comprising identifiers of each of the subset of the plurality of enabled features to the secured device;

receive the authentication message transmitted by the computing system; and generate an access control command based on the authentication message, wherein the access control command is structured to at least one of grant or deny access to the secured device based on the authentication message; and an access device structured to perform an action based on the subset of the plurality of enabled features.

16. The secured device of claim 15, wherein the secured device is a vault door.

17. The secured device of claim 16, wherein the access device is a lock provided by the vault door.

18. The secured device of claim 17, wherein the lock provided by the vault door is structured to unlock to grant access to a vault associated with the vault door.

19. The secured device of claim 17, wherein the lock provided by the vault door is structured to lock to deny access to a vault associated with the vault door.

20. The secured device of claim 15, wherein the processing circuit receives the authentication message generated further based on a management decision signal.

* * * * *